US009895573B2

(12) United States Patent
Domesick

(10) Patent No.: US 9,895,573 B2
(45) Date of Patent: Feb. 20, 2018

(54) PLANK SUPPORT EXERCISE APPARATUS AND RELATED METHODS

(71) Applicant: Michael H. Domesick, Worcester, MA (US)

(72) Inventor: Michael H. Domesick, Worcester, MA (US)

( * ) Notice: Subject to any disclaimer, the term of this patent is extended or adjusted under 35 U.S.C. 154(b) by 0 days.

(21) Appl. No.: 14/631,235

(22) Filed: Feb. 25, 2015

(65) Prior Publication Data

US 2015/0238795 A1 Aug. 27, 2015

Related U.S. Application Data

(60) Provisional application No. 61/944,154, filed on Feb. 25, 2014.

(51) Int. Cl.

| | |
|---|---|
| ***A63B 21/00*** | (2006.01) |
| ***A63B 21/002*** | (2006.01) |
| ***A63B 21/068*** | (2006.01) |
| ***A63B 22/14*** | (2006.01) |
| ***A63B 22/16*** | (2006.01) |
| ***A63B 23/02*** | (2006.01) |
| ***A63B 23/12*** | (2006.01) |
| ***A63B 71/00*** | (2006.01) |

(52) U.S. Cl.

CPC ..... *A63B 23/0205* (2013.01); *A63B 21/0023* (2013.01); *A63B 21/00047* (2013.01); *A63B 21/068* (2013.01); *A63B 21/4035* (2015.10); *A63B 22/14* (2013.01); *A63B 22/16* (2013.01); *A63B 23/1236* (2013.01); *A63B 21/00181* (2013.01); *A63B 21/4039* (2015.10); *A63B 71/0054* (2013.01); *A63B 2208/0257* (2013.01); *A63B 2208/0261* (2013.01); *A63B 2208/0295* (2013.01); *A63B 2225/09* (2013.01)

(58) Field of Classification Search

CPC .. A63B 21/00081–21/00109; A63B 21/00127; A63B 21/00185; A63B 21/002–21/0023; A63B 21/0205; A63B 21/1457–21/1476; A63B 22/16; A63B 22/18; B62K 21/125

See application file for complete search history.

(56) References Cited

U.S. PATENT DOCUMENTS

| | | | | |
|---|---|---|---|---|
| 5,163,339 A * | 11/1992 | Giard, Jr. | ..... | B62K 21/125 403/374.4 |
| 5,713,823 A * | 2/1998 | Walendzak | ..... | A63B 22/18 482/139 |
| 6,582,347 B2 | 6/2003 | Smith | | |
| 6,638,201 B1 | 10/2003 | Dischler | | |
| 7,601,108 B2 | 10/2009 | Andrews | | |

(Continued)

FOREIGN PATENT DOCUMENTS

| | | |
|---|---|---|
| WO | 2009042255 A1 | 4/2009 |
| WO | 2013009306 A1 | 1/2013 |

*Primary Examiner* — Loan H Thanh
*Assistant Examiner* — Jennifer M Deichl

(57) ABSTRACT

A plank support exercise apparatus and related methods is provided. The plank support exercise apparatus has a hand grip and a frame member extending from the hand grip. At least one arm support pad is connected to the frame member, wherein a distance between the hand grip and the at least one arm support pad is adjustable. A ground-interface surface is positioned along at least a portion of the frame member.

7 Claims, 25 Drawing Sheets

(56) References Cited

U.S. PATENT DOCUMENTS

| | | | | |
|---|---|---|---|---|
| 7,611,445 | B2 | 11/2009 | Brown et al. | |
| 7,698,967 | B2 | 4/2010 | Ording et al. | |
| 7,938,763 | B2 | 5/2011 | Campanaro et al. | |
| 7,972,251 | B2 | 7/2011 | Peddar | |
| 8,177,732 | B2 * | 5/2012 | Einav et al. | 601/5 |
| 2006/0030463 | A1 * | 2/2006 | Maloy et al. | 482/126 |
| 2008/0108487 | A1 * | 5/2008 | Bizzell et al. | 482/142 |
| 2010/0234776 | A1 | 9/2010 | Borden | |
| 2012/0258843 | A1 * | 10/2012 | Summers | A63B 21/0603 482/93 |
| 2013/0065736 | A1 * | 3/2013 | Chen | 482/96 |
| 2014/0005007 | A1 * | 1/2014 | Ho et al. | 482/96 |
| 2014/0087925 | A1 * | 3/2014 | Dupuis | A63B 21/062 482/97 |

* cited by examiner

PLANK SUPPORT EXERCISE APPARATUS AND RELATED METHODS

CROSS REFERENCE TO RELATED APPLICATION

This application claims benefit of U.S. Provisional Application Ser. No. 61/944,154 entitled, "Device for Facilitating Plank Exercises" filed Feb. 25, 2014, the entire disclosure of which is incorporated herein by reference.

FIELD OF THE DISCLOSURE

The present disclosure is generally related to exercise devices and more particularly is related to a plank support exercise apparatus and related methods.

BACKGROUND OF THE DISCLOSURE

A plank exercise is an isometric core strength exercise that involves maintaining a difficult position for extended periods of time. The most common plank is the front plank which is held in a push-up position with the body's weight borne on forearms, elbows, and toes. FIG. 1 is a side view illustration of person 10 in a front plank position, in accordance with the prior art. This type of exercise may also be known as a front hold, hover, or abdominal bridge. As is shown in FIG. 1, when in the front plank position, a person 10 may maintain a push-up-like stance with his or her forearms in contact with the ground surface 12. In this position, the body weight of the person 10 is transferred through their feet and through their upper arms to the ground 12. Relevant to this disclosure, the transfer of the weight through the upper arms to the ground 12 places significant forces on the person's elbows, which are in contact with the ground 12.

Variations on the plank exercise include alternative positions, such as the side plank, the reverse plank, and/or the so-called 'superman' plank. FIG. 2 is a side view illustration of person 10 in a side plank position, in accordance with the prior art. In the side plank, the person 10 maintains a static position with a single forearm and single foot in contact with the ground 12. In this position, the bodyweight of the person 10 is transferred through his or her single foot and single arm which maintain contact with the ground 12. Relevant to this disclosure, the transfer of the weight through the single upper arm to the ground 12 places a significant force on the elbow of the person which is in contact with the ground 12.

Plank exercises may further include the use of training devices to enhance the effect of the exercise on the person. As is well-known in the art, these training devices may include a padded mat or weighted athletic balls which the person balances his or her bodyweight on while maintaining a plank position or a modified plank position. In all variations of the plank position, the person may experience a balance and core conditioning exercise by requiring muscles in the person's legs, torso, back, and upper body to remain in a static position, thereby increasing strength, control, and coordination of the muscles within the person's body. The health benefits of plank exercises are well documented throughout the health, fitness, and exercise science industries. However, there are also some drawbacks of plank exercise, including the discomfort a user experiences at his or her elbows, due to the localized force of their bodyweight being transferred through the elbow.

Some devices are available to assist plank exercises. One device includes a unitary shell with handle grips and a platform, and a sliding device positioned on an underside of the platform. A user may grasp the handle grips with his or her elbows in contact with the platform and his or her knees in contact with the ground surface. The user then exercises his or her abdominal muscles by sliding the unitary shell on the ground relative to his or her knees. A similar device uses independent sliding carriages for each arm of the user, whereby a plank position can be assumed on the carriages. It is noted that other plank exercise assisting devices, functioning under the same principles as described herein, may also exist in the conventional art.

These devices, along with other conventional devices, have many shortcomings. One major shortcoming is that the devices use unrestricted sliding movement, such that users are highly susceptible to inadvertently overextending exercise positions which can result in injury. Further, the devices require a user's forearm to be positioned in such a way that their bodyweight is transferred through their elbow and into the device. While some padding on the device may alleviate some of the discomfort to the user's elbow, it falls far short of eliminating the discomfort. Additionally, conventional devices often have handle grips that are not ergonomically safe. For example, many devices have handle grips positioned aligned with or higher than the user's arm, which results in an upwards pitching of the user's wrist. Long term, this position can result in strain on the user's wrist and forearm. This position may also prevent a user from exerting downward pressure on handle grips in order to leverage their body into an elevated position specific to a plank exercise, without further forcing their arm and/or elbow into a pad. In another example, the conventional handle grips are usually oriented at right angles to the ground, which forces the user's forearms and wrist into an ergonomically inefficient position.

Thus, a heretofore unaddressed need exists in the industry to address the aforementioned deficiencies and inadequacies.

SUMMARY OF THE DISCLOSURE

Embodiments of the present disclosure provide a plank support exercise apparatus. Briefly described, in architecture, one embodiment of the apparatus, among others, can be implemented as follows. A plank support exercise apparatus has a hand grip. A frame member extends from the hand grip. At least one arm support pad is connected to the frame member, wherein a distance between the hand grip and the at least one arm support pad is adjustable. A ground-interface surface is positioned along at least a portion of the frame member.

The present disclosure can also be viewed as providing a plank support exercise apparatus. Briefly described, in architecture, one embodiment of the apparatus, among others, can be implemented as follows. The plank support exercise apparatus has a hand grip. A frame member extends from the hand grip. At least one forearm support pad is connected to the frame member, wherein the at least one forearm support pad is contactable by a forearm of a user. A ground-interface surface is positioned along at least a portion of the frame member, wherein a force from a weight of the user in a position with the forearm thereof on the at least one forearm support pad is transferred from the forearm of the user, through the at least one forearm support pad, and through the ground-interface surface to a ground surface.

The present disclosure can also be viewed as providing a plank support exercise apparatus. Briefly described, in architecture, one embodiment of the apparatus, among others, can be implemented as follows. The plank support exercise apparatus has a hand grip. A frame member extends from the hand grip. At least one arm support pad is connected to the frame member. A ground-interface surface is positioned along at least a portion of the frame member, wherein the frame member is translationally static relative to a ground surface.

The present disclosure can also be viewed as providing methods of using a plank support exercise apparatus. In this regard, one embodiment of such a method, among others, can be broadly summarized by the following steps: the steps of: providing the plank support exercise apparatus having a hand grip, a frame member extending from the hand grip, at least one forearm support pad connected to the frame member, and a ground-interface surface positioned along at least a portion of the frame member; and transferring a force from a weight of a user in a position with a forearm thereof on the at least one forearm support pad from the forearm of the user, through the at least one forearm support pad, and through the ground-interface surface to a ground surface.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 3:
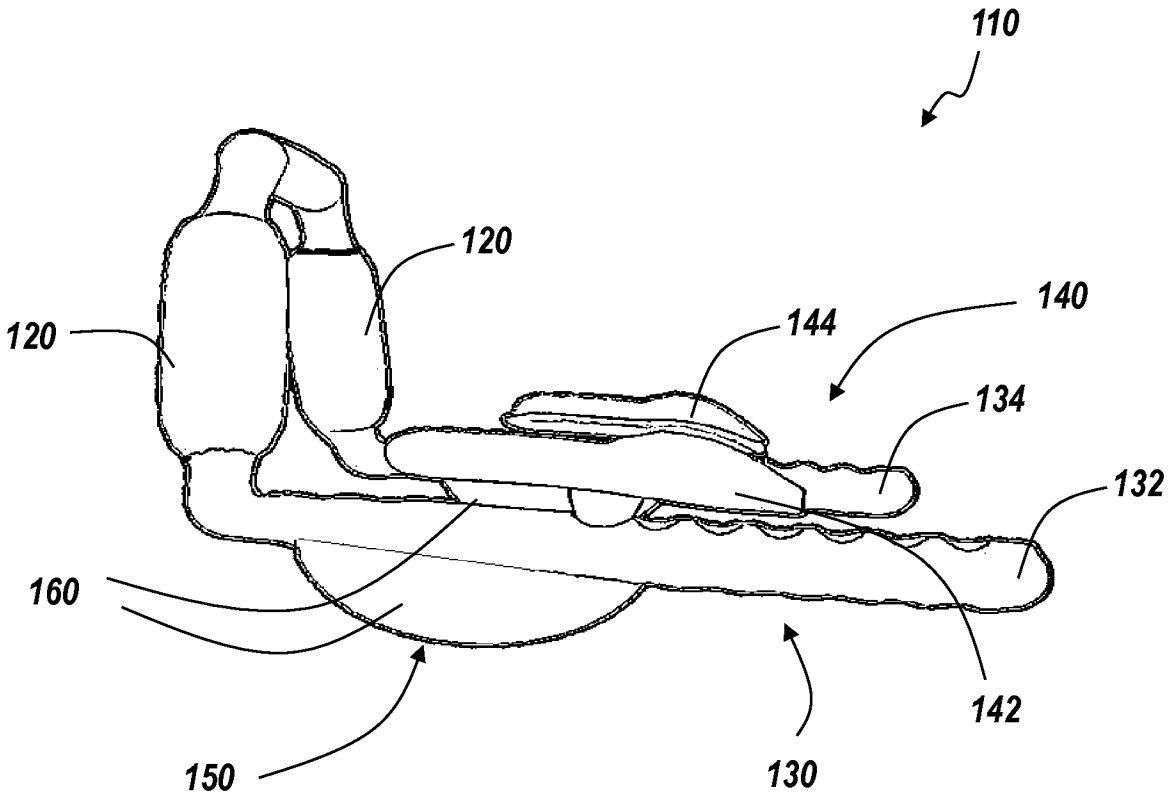
FIG. 3 is a side-view illustration of a plank support exercise apparatus, in accordance with a first exemplary embodiment of the present disclosure.

FIG. 3 is a side-view illustration of a plank support exercise apparatus 110, in accordance with a first exemplary embodiment of the present disclosure. The plank support exercise apparatus 110, which may be referred to herein as 'apparatus 110' includes a hand grip 120. A frame member 130 extends from the hand grip 120. At least one arm support pad 140 is connected to the frame member 130, wherein a distance between the hand grip 120 and the at least one arm support pad 140 is adjustable. A ground-interface surface 150 is positioned along at least a portion of the frame member 130.

Figure 1:
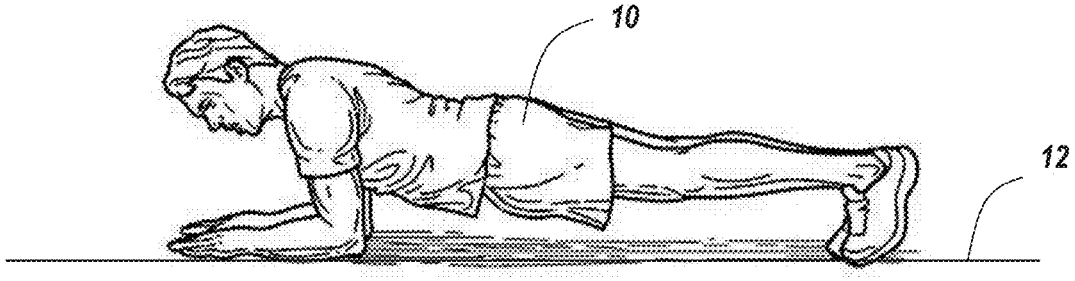
FIG. 1 (Prior Art)
FIG. 1 is a side view illustration of person in a front plank position, in accordance with the prior art.

The apparatus 110 may be used to assist or aid in plank exercises where the user maintains a static, isometric position. Accordingly, when the apparatus 110 is used, the user may be positioned in the conventional plank position, as is shown in FIG. 1, but with his or her hands grasping the hand grip 120 and his or her forearms in contact with the at least one arm support pad 140. The apparatus 110 may offer significant benefits to users, as detailed throughout this disclosure. Further, it is noted that the apparatus 110 may include many variations in structure, components, and function, all of which are considered within the scope of the present disclosure.

Relative to FIG. 3, the frame member 130 may be a bifurcated frame member having a first leg 132 and a second leg 134. Each of the first and second legs 132, 134 may be positioned on opposing sides of the hand grip 120 such that the first and second legs 132, 134 is connected between the hand grip 120 and the at least one arm support pad 140.

Further, it may be common for the at least one arm support pad 140 to include a first arm support pad 142 and a second arm support pad 144, each connected to one of the first and second legs 132, 134 of the frame member 130. Other designs of the apparatus 110 may include a single frame member 130 which is positioned substantially central to the hand grip 120 and/or the at least one arm support pad 140, as is discussed relative to FIG. 23-24.

As is shown in FIG. 3, the hand grip 120 may be integrally formed within a forward section of the bifurcated frame member 130, wherein each of the first and second legs 132, 134 extend from opposing sides of the hand grip 120, respectively. The hand grip 120 may include an ergonomic structure that can be grasped by the user's hand when using the apparatus 110. The hand grip 120 may include, for example, a substantially cylindrical structure which is covered, partially or fully, with padding, foam, texturized material, or another material to enhance ease of use of the hand grips 120. The hand grip 120 may also have a position that provides fully ergonomic use of the apparatus 110. These ergonomic positions may include the hand grip 120 being positioned slightly below a plane of the user's arm when resting on the arm support pad 140, such that the user's wrist can bend slightly downward, and/or the hand grip 120 being positioned at an angle, relative to a vertical position, inwardly towards a center of the apparatus 110. Other orientations of the hand grips may also be used to enhance ergonomic use of the apparatus 110. The first and second legs 132, 134 of the frame member 130 may extend from the hand grip 120 in a variety of configurations, such as a straight extension, as shown in FIG. 3. Commonly, the first and second legs 132, 134 of the frame member 130 may include a tubular member which has a rigid, durable construction capable of supporting the bodyweight of the user.

The first and second arm support pads 142, 144 may include structures which are positioned on or carried by the first and second legs 132, 134, such that the first and second arm support pads 142, 144 can be positioned along a length of the first and second legs 132, 134. Commonly, the first and second arm support pads 142, 144 include a rigid or semi-rigid structure having a curvilinear shape which matches or substantially matches a human forearm shape. The curvilinear shape may be characterized as a curvilinear arm contact surface which can substantially conform to an outer radial surface of the forearm of the user when the user is positioned with his or her forearm on the arm support pad. The first and second arm support pads 142, 144 may include padding to increase comfort of the user when his or her bodyweight is placed on the first and second arm support pads 142, 144.

When in use, the apparatus 110 may be positioned on a ground surface, which may include any type of athletic supporting surface, such as pavement, a grassy field, a gym floor, or others. The apparatus 110 may include a number of points which make contact with the ground surface. Primarily, the ground-interface surface 150 may be used to interface the contact between the apparatus 110 and the ground surface, and other points along the apparatus 110 may aid or assist in supporting the apparatus 110 on the ground. The ground-interface surface 150 may be any surface or surfaces along a bottom edge of the frame member 130 or other structures extending from the frame member 130.

Figure 4:
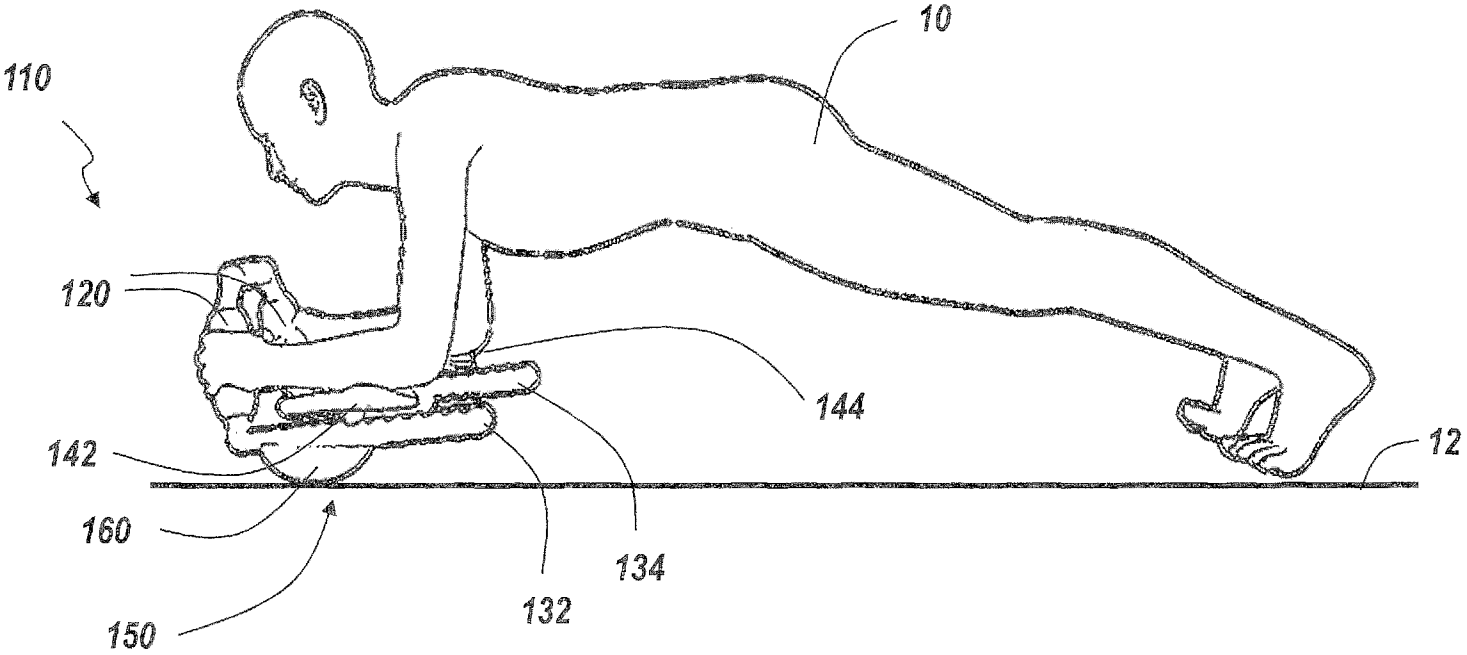
FIG. 4 is a side-view illustration of a plank support exercise apparatus in use with a user 10, in accordance with the first exemplary embodiment of the present disclosure.

FIG. 4 is a side-view illustration of a plank support exercise apparatus 110 in use with a user 10, in accordance with the first exemplary embodiment of the present disclosure. The user 10 in FIG. 4 is positioned in a plank exercise position on the apparatus 110, whereby the user is in a static, push-up-like position with his or her hands grasping the hand grip 120 and his or her forearms positioned on the first and second arm support pads 142, 144. The position of the user's spaced forearms and less-spaced hands may form a triangular shape, which may correspond to a heightened ergonomic position. In this position, the user's bodyweight is being transferred through his or her feet to a surface of the ground 12 and through his or her upper arms and into the apparatus 110. Specific to the transfer of forces through the user's arms, unlike conventional devices which require the force to be transferred directly through the localized area of the elbow, the apparatus 110 allows the force to be distributed across the user's forearms and into the first and second arm support pads 142, 144, as well as through the user's hands to the hand grip 120. This distribution of force may prevent harmful concentrated forces from being transferred through the user's elbows, which can lessen the chance of injury or discomfort to the user's elbows. Furthermore, since the point of force transfer is removed from the elbows of the user, the user may be required to use his or her hands to stabilize the plank position on the apparatus 110, in contrast to a plank exercise without a hand grip, where the user's hands offer little additional support to maintain the static plank position.

Relative to FIGS. 3-4, the apparatus 110 may have the ground-interface surface 150 positioned on a destabilizing device 160. The destabilizing device 160 may be connected to the frame member 130, or one or both of the first and second legs 132, 134 thereof, and may facilitate a controlled, destabilizing movement of the frame member 130. The controlled, destabilizing movement may include, for example, a pivoting of the frame member 130 about a pivot axis located within the destabilizing device 160. This pivoting movement may be achieved by providing a ground-interface surface 150 which is positioned along the curved surface of the destabilization device 160. In this example, the ability of the apparatus 110 to pivot may allow the user to achieve an enhanced exercise, since maintaining the static plank position on the apparatus 110 without destabilization utilizes additional muscles within the user's torso and upper body. The destabilizing device 160 can be moved or positioned along the length of the first and second legs 132, 134 to connect thereto at different attachment points. Varying the point of attachment of the destabilization device 160 to the frame member 130 may vary the degree of instability or destabilization of the apparatus 110, which can be used to effect different exercises on the apparatus 110. It is also noted that the destabilization device 160 may include a variety of different shapes and/or curvatures to effect different levels of instability, such as, for example, shortened curvatures, enlarged curvatures, constant radii curvatures, or variable radii curvatures, to name a few.

It is important to note that the controlled, destabilized movement of the apparatus 110 may be limited to translationally static movement, such that neither the apparatus 110 nor the user 10 on the apparatus 110 moves translationally. Rather, the controlled, destabilized movement may include only rotational movement about one or more axes. In some cases, such as shown in FIGS. 3-4, the rotational movement may be limited to movement in a single degree of freedom, e.g., rotational movement about an axis of curvature of the curved surface of the destabilizing device 160. This single degree of freedom movement may allow the apparatus 110 to pivot or rock about the destabilizing device 160, which provides an enhanced plank exercise experience. However, limiting the destabilizing movement to rotational movement only prevents the user from being exposed to injurious situations rife in the conventional art, where an exercise device can slip translationally (forwards, backwards, left, or right) out from underneath the user 10. A variety of other destabilizing devices 160 can be employed with the apparatus 110, as are discussed relative to other figures.

Figure 5:
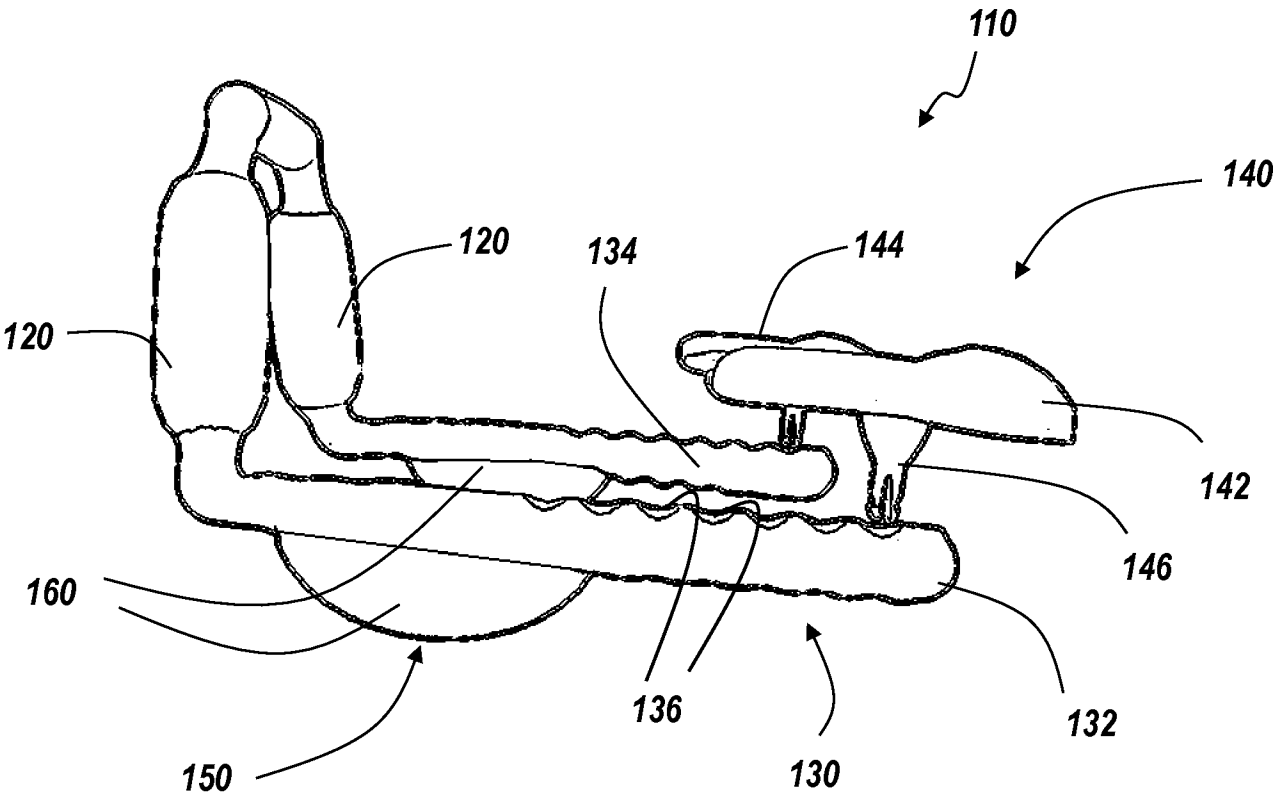
FIG. 5 is a side-view illustration of a plank support exercise apparatus, in accordance with the first exemplary embodiment of the present disclosure.

FIG. 5 is a side-view illustration of a plank support exercise apparatus 110, in accordance with the first exemplary embodiment of the present disclosure. One of the benefits of the apparatus 110 is its ability to be easily adjusted to users of different body sizes. One way of achieving this adjustability is by adjusting a distance between the hand grip 120 and the at least one arm support pad 140 by moving the at least one arm support pad 140 along a length of the frame member 130. There may be a number of ways to achieve this adjustability, one of which includes utilizing a plurality of holes 136 positioned at spaced intervals within the frame member 130, or within each of the first and second legs 132, 134 of the frame member 130. These holes 136 may receive an extended connector 146 which is positioned on the at least one arm support pad 140, or on both of the first and second arm support pads 142, 144. Similarly, the destabilizing device 160 may be adjustable between positions along the length of the frame member 130 to vary a point of controlled, destabilized movement. The destabilizing device 160 may incorporate the same or similar extended connector 146 as the arm support pads 140.

The extended connector 146 may include, for example, a male fastener which can be positioned within the hole 136 to locate the arm support pad 140 substantially above or proximate to the hole 136. By varying the positioning of the extended connector 146 within the plurality of holes 136, the user can select which positioning of the arm support pad 140 is desired. The extended connector 146 may include features to retain it within the hole 136, such as a biased or snap connector. One type of extended connector 146 may utilize a tab and slot system, where when the extended connector 146 is moved into the hole, a tab on the interior sidewall of the hole 136 is received within a shortened slot in the extended connector 146. Once the extended connector 146 achieves a fully-inserted position, the tab may be positioned beyond the slot where the extended connector 146 may be rotated to lock the extended connector 146 within the hole 136.

Figure 6:
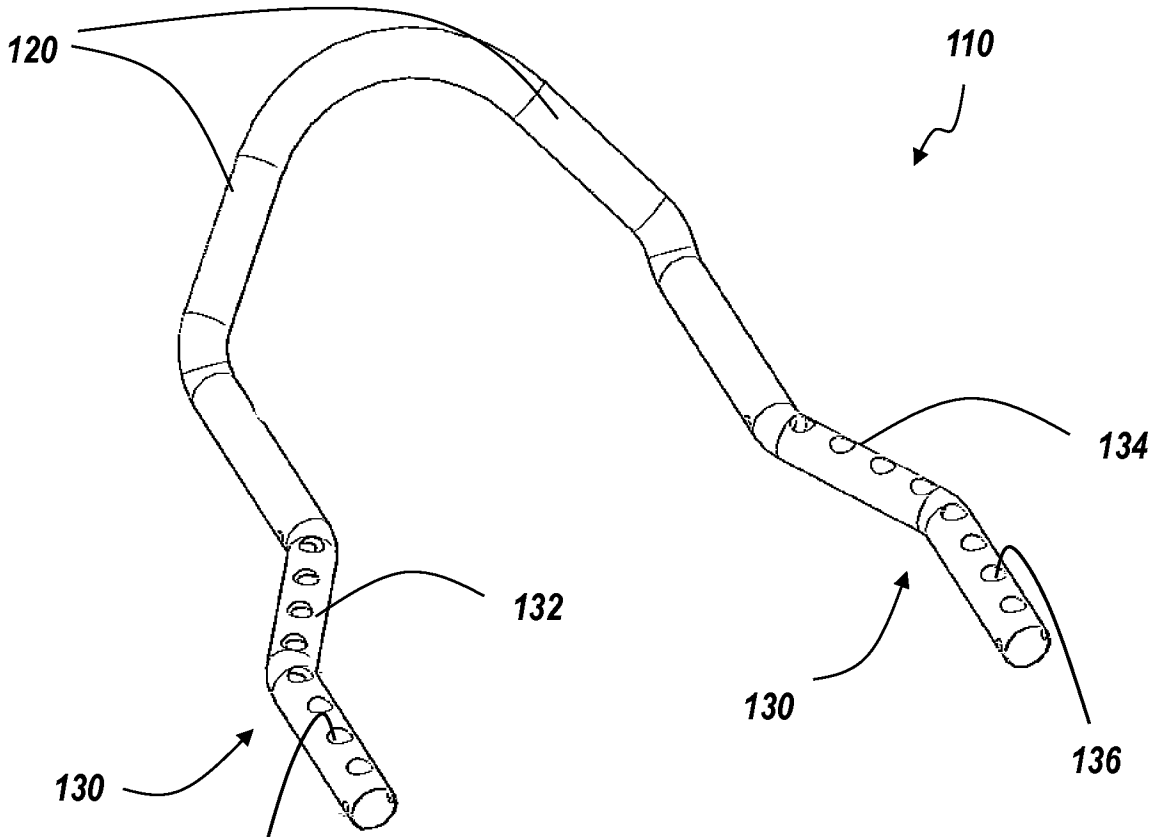
FIG. 6 is an isometric view illustration of a plank support exercise apparatus, in accordance with the first exemplary embodiment of the present disclosure.

FIG. 6 is an isometric view illustration of a plank support exercise apparatus 110, in accordance with the first exemplary embodiment of the present disclosure. Specifically, FIG. 6 depicts the hand grips 120 formed integral with a bifurcated frame member 130 having first and second legs 132, 134. Each of the first and second legs 132, 134 may have a specific shape which allows for more adjustability of the apparatus 110. As is shown, each of the first and second legs 132, 134 may include holes 136 which are positioned for arm support pad attachment along various portions of the first and second legs 132, 134. These various portions of the first and second legs 132, 134 may include straight and angularly positioned lengths, such that the relative distance between the first leg 132 and the second leg 134 can be variable, dependent on which location along the first and second leg 132, 134 is selected. As is further shown in FIG. 6, the relative distance between the first leg 132 to the second leg 134 can be variable along one section of the frame member 130, e.g., the angularly-positioned, middle section, and constant along a different section of the frame member 130, e.g., the section proximate to a terminating end of each of the first and second legs 132, 134. Any combination of variable and/or constant distances may be used.

Figure 7:
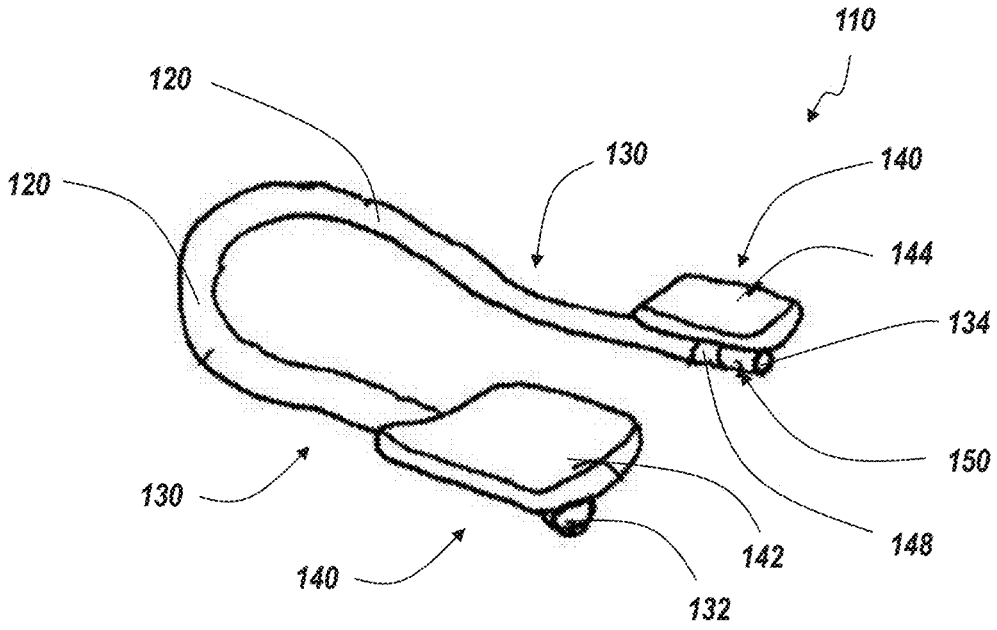
FIG. 7 is an isometric view illustration of a plank support exercise apparatus, in accordance with the first exemplary embodiment of the present disclosure.

FIG. 7 is an isometric view illustration of a plank support exercise apparatus 110, in accordance with the first exemplary embodiment of the present disclosure. FIG. 7 illustrates the apparatus 110 having a bifurcated frame member 130 with first and second legs 132, 134 that are integrally connected to the hand grip 120. The arm support pad 140 includes first and second arm support pads 142, 144 which are positioned on the each of the first and second legs 132, 134, respectively. Instead of using holes and extended connectors, the first and second arm support pads 142, 144 may utilize a strap 148 which is connected to each of the first and second arm support pads 142, 144 and positioned around each of the first and second legs 132, 134, respectively. The strap 148 may be movable along the length, or a portion of the length, of the first and second legs 132, 134 to adjust the position of the first and second arm support pads 142, 144. The strap 148 may include a variety of components to enhance usability, include a high-friction material coating an exterior of the strap 148. The exterior of the strap 148 surface having the high-friction material may act as the ground-interface surface 150 to retain the apparatus 110 in place during use.

Figure 8:
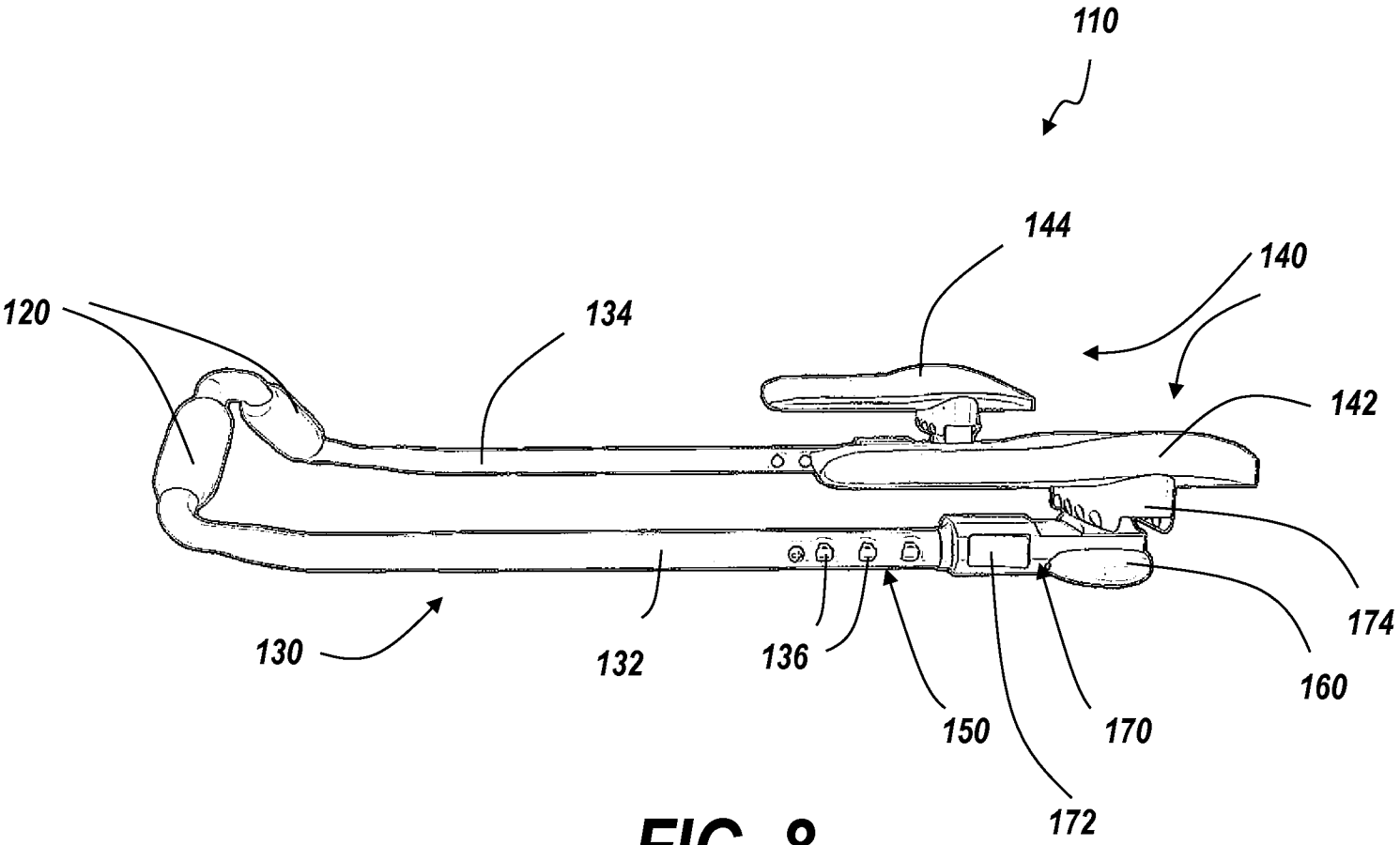
FIG. 8 is a side-view illustration of a plank support exercise apparatus, in accordance with the first exemplary embodiment of the present disclosure.

FIG. 8 is a side-view illustration of a plank support exercise apparatus 110, in accordance with the first exemplary embodiment of the present disclosure. The plank support exercise apparatus 110 includes the hand grip 120 and a bifurcated frame member 130 extending from the hand grip 120, wherein first and second legs 132, 134 are connected to either side of the hand grip 120. The arm support pad 140 includes first and second arm support pads 142, 144 which are each connected to one of the first and second legs 132, 134. A distance between the hand grip 120 and the first and second arm support pads 142, 144 is adjustable. A ground-interface surface 150 is positioned along at least a portion of the frame member 130.

The apparatus 110 of FIG. 8 includes some variations relative to FIGS. 3-7. For example, the apparatus 110 of FIG. 8 may include side-mounted holes 136 positioned along each of the first and second legs 132, 134. The first and second arm support pads 142, 144 may be carried on a hub 170 which interfaces between the first and second legs 132, 134 and the first and second arm support pads 142, 144, respectively. The hub 170 may be connected to the destabilizing device 160 and include one or more extended connectors (not shown) which can be engaged with one of the plurality of holes 136 to adjust the location of the arm support pads 140 along the frame member 130. To control engagement of the extended connectors with the holes 136, an actuatable engagement device 172 may be used, where actuation of the actuatable engagement device 172 disengages the extended connector from the hole 136 to permit the arm support pad 140 to move along at least a portion of the length of the frame member 130. The actuatable engagement device 172 may include a button or other feature which can be depressed to disengage the extended connector from the hole 136. Various designs may be used to facilitate the internal functioning of the actuatable engagement device 172.

Figure 9:
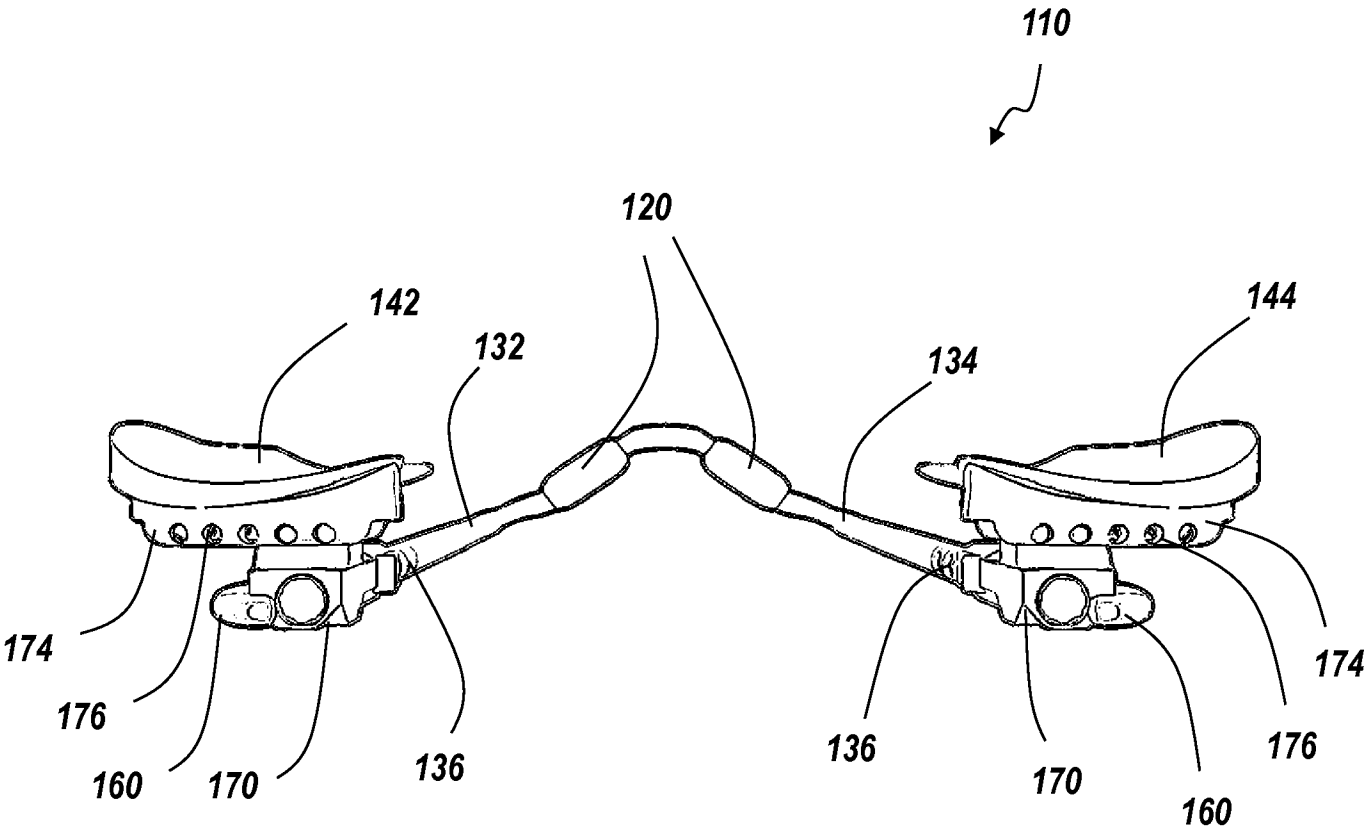
FIG. 9 is a rear-view illustration of a plank support exercise apparatus, in accordance with the first exemplary embodiment of the present disclosure.

It is further noted that a variety of mechanical interfaces may be used to facilitate the adjustment or sliding of the first and second arm support pads 142, 144 on the first and second legs 132, 134, respectively. For example, the first and second legs 132, 134 may have a substantially cylindrical shape, a partially cylindrical shape, or a non-cylindrical shape such as a square shape, e.g., when square tubing members are used to form the first and second legs 132, 134. Any cross-sectional shape of the first and second legs 132, 134 may be utilized and the hub 170, or another component to coordinate adjustment of the first and second arm support pads 142, 144, may have a corresponding shape. In another example, the hub 170 may be positioned only on an upper half of each of the first and second legs 132, 134, as opposed to fully encircling the first and second legs 132, 134. It is also possible to use any number or type of grooves, ridges, guiding features, or other structural designs that facilitate successful movement of the first and second arm support pads 142, 144 on the first and second legs 132, 134, all of which are considered to be within the scope of the present disclosure. FIG. 9 is a rear-view illustration of a plank support exercise apparatus 110, in accordance with the first exemplary embodiment of the present disclosure. The hub 170 may also include a lateral movement device 174 which supports the first and second arm support pads 142, 144 and controls a lateral movement thereof. The lateral movement of the first and second arm support pads 142, 144, as depicted in FIGS. 8-9, may be along a lateral direction which is oriented substantially perpendicular to a length of the frame member 130 and a length of the first and second legs 132, 134. Thus, while the plurality of holes 136 and the extended connector, or similarly functioning device, may allow adjustability of the first and second arm support pads 142, 144 along the length of the first and second legs 132, 134, the lateral movement device 174 may control movement of the first and second arm support pads 142, 144 in a different direction. Lateral movement of the first and second arm support pads 142, 144 may facilitate the varied shoulder widths of users, allowing the apparatus 110 to properly match each user's body size. While the lateral movement device 174 may include a variety of mechanical structures to facilitate lateral movement, the lateral movement device 174 of FIG. 9 may include a plurality of holes 176 spaced at intervals along the length of the lateral movement device 174. A portion of the hub 170 may extend upwards into the lateral movement device 174 and a biasable pin or other fastener may connect the lateral movement device 174 to the hub 170.

Figure 2:
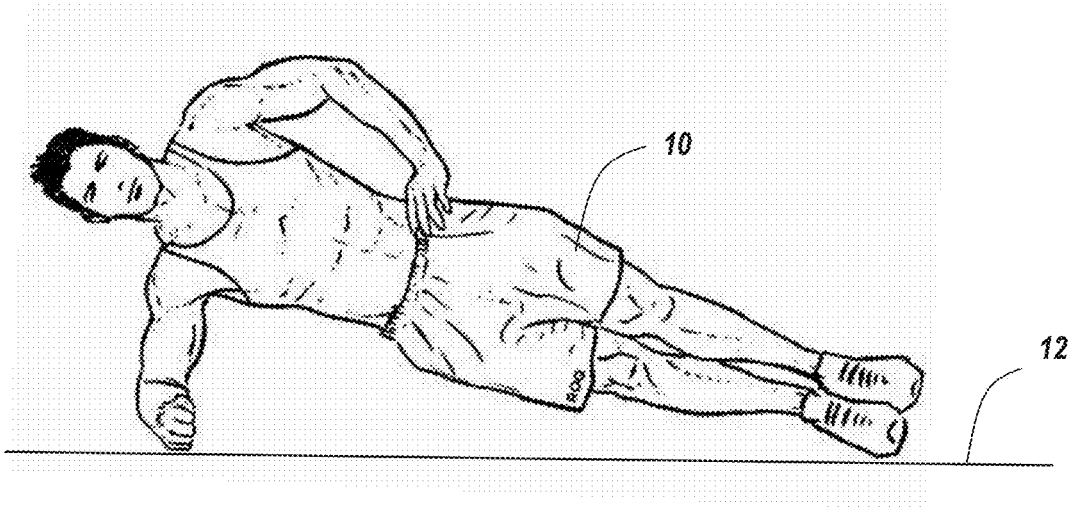
FIG. 2 (Prior Art)
FIG. 2 is a side view illustration of person in a side plank position, in accordance with the prior art.
Figure 10:
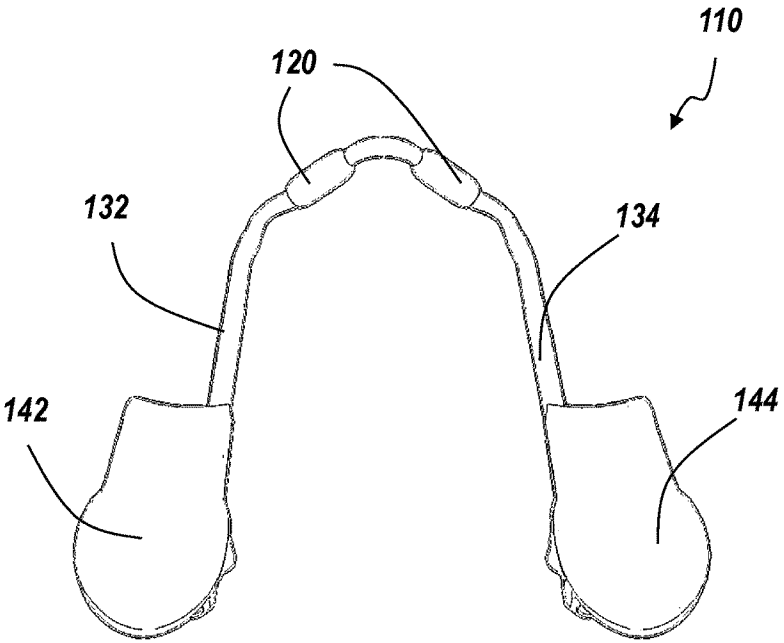
FIGS. 10-11 are top-view illustrations of a plank support exercise apparatus, in accordance with the first exemplary embodiment of the present disclosure.
Figure 11:
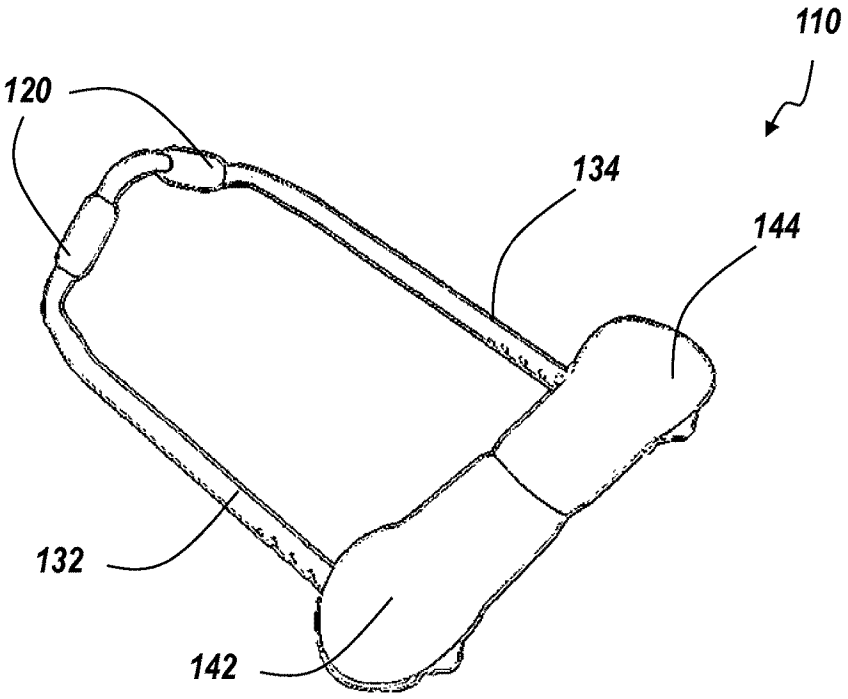

FIGS. 10-11 are top-view illustrations of a plank support exercise apparatus 110, in accordance with the first exemplary embodiment of the present disclosure. While FIG. 10 illustrates the first and second arm support pads 142, 144 in a straight-forward orientation, it is possible for the first and second arm support pads 142, 144 to be rotated to achieve an inward-facing orientation, as shown in FIG. 11. Rotation of the first and second arm support pads 142, 144 may be about a substantially vertical axis positioned through each of the first and second arm support pads 142, 144. The rotation of the first and second arm support pads 142, 144 may be limited to a specific degree of movement, such as a 90 degree movement. This 90 degree movement of each of the first and second arm support pads 142, 144 may allow the separate first and second arm support pads 142, 144 to abut or substantially abut one another to provide, in effect, a combined arm support pad 140. The combined arm support pad 140 may be used primarily for users in a side plank position, as shown in FIG. 2, where the user's forearm can be positioned in the combined arm support pad 140 to provide additional support during the exercise.

While a 90 degree rotation of the first and second arm support pads 142, 144 may be common to form the combined arm support pad 140, a rotation of less than 90 degrees may also have benefits. For example, rotation of the first and second arm support pads 142, 144 may also help orient the user's wrist at a comfortable trajectory to the hand grips 120, thereby adjusting the first and second arm support pads 142, 144 for users with different arm or body sizes. The adjustability of the first and second arm support pads 142, 144 allows the user to achieve a comfortable trajectory to the hand grips 120, regardless of their body size or personal trajectory preference.

Figure 12:
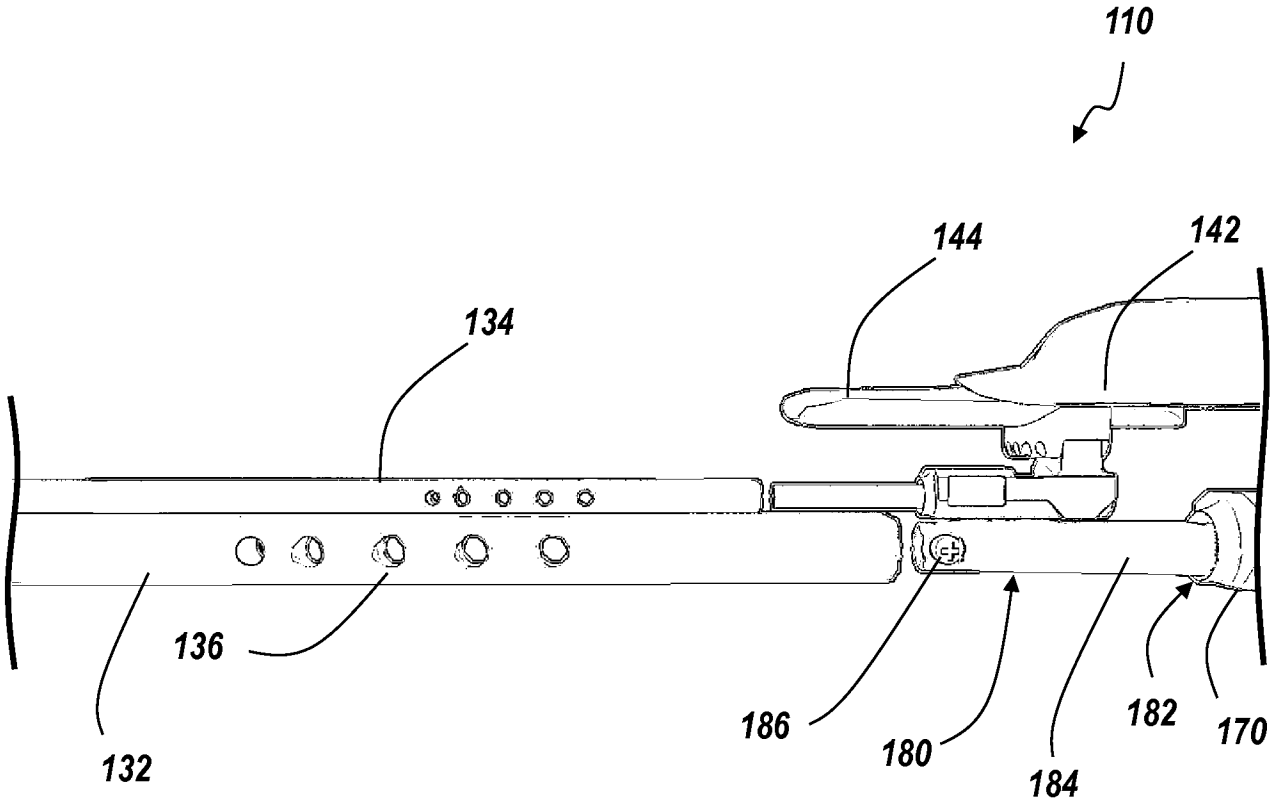
FIG. 12 is a partially exploded side-view illustration of a plank support exercise apparatus, in accordance with the first exemplary embodiment of the present disclosure.

FIG. 12 is a partially exploded side-view illustration of a plank support exercise apparatus 110, in accordance with the first exemplary embodiment of the present disclosure. As is shown in FIG. 12, the first and second arm support pads 142, 144 may attach to the first and second legs 132, 134 using a post 180 which can be positioned inside each of the first and second legs 132, 134. The post 180 has an outer diameter that is smaller than an inner diameter of the first and second legs 132, 134. The hub 170 supporting the first and second arm support pads 142, 144 may include an interior cavity 182 which can receive the distal end of the first and second legs 132, 134 when the post 180 of each of the first and second arm support pads 142, 144 is positioned in the first and second legs 132, 134, respectively.

The post 180 may further include a groove 184 therein which runs along a length of the post 180. The groove 184 may engage with a fastener 186, such as a blunt-tip screw, which can be positioned through one of the holes 136 in the first and second legs 132, 134 (in FIG. 12, the fastener 186 is shown engaged with the groove 184). When the post 180 is positioned within the interior of the leg 132, for example, the post 180 may be moved therein with the end of the fastener 186 engaged with the groove 184. A tip of the post 180 may have a stop to prevent the fastener 186 from exiting the groove 184, thereby preventing disconnection of the first and second arm support pads 142, 144 from the first and second legs 132, 134, respectively.

Figure 13:
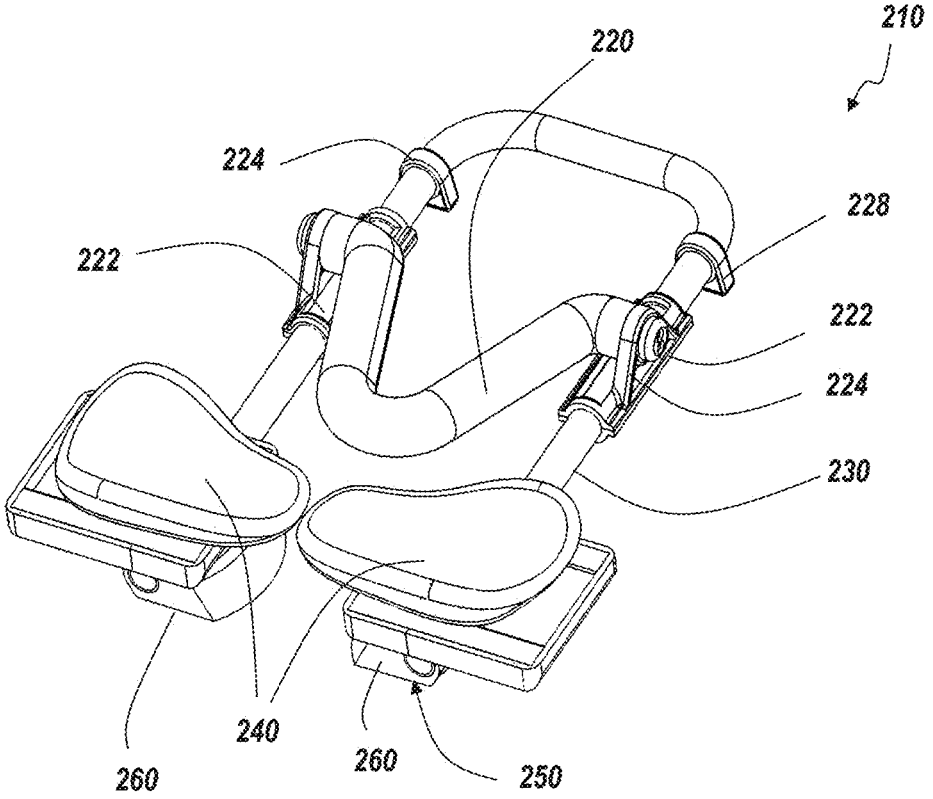
FIG. 13 is an isometric view illustration of a plank support exercise apparatus, in accordance with a second exemplary embodiment of the present disclosure.

FIG. 13 is an isometric view illustration of a plank support exercise apparatus 210, in accordance with a second exemplary embodiment of the present disclosure. The plank support exercise apparatus 210, which may be referred to herein as 'apparatus 210' may be substantially similar to the apparatus 110 described with respect to FIGS. 3-12, and may include any of the features, components, or functions discussed relative to FIGS. 3-12. The apparatus 210 of FIG. 13 includes a hand grip 220. A frame member 230 extends from the hand grip 220. At least one arm support pad 240 is connected to the frame member 230, wherein a distance between the hand grip 220 and the at least one arm support pad 240 is adjustable. A ground-interface surface 250 is positioned along at least a portion of the frame member 230.

Figure 14:
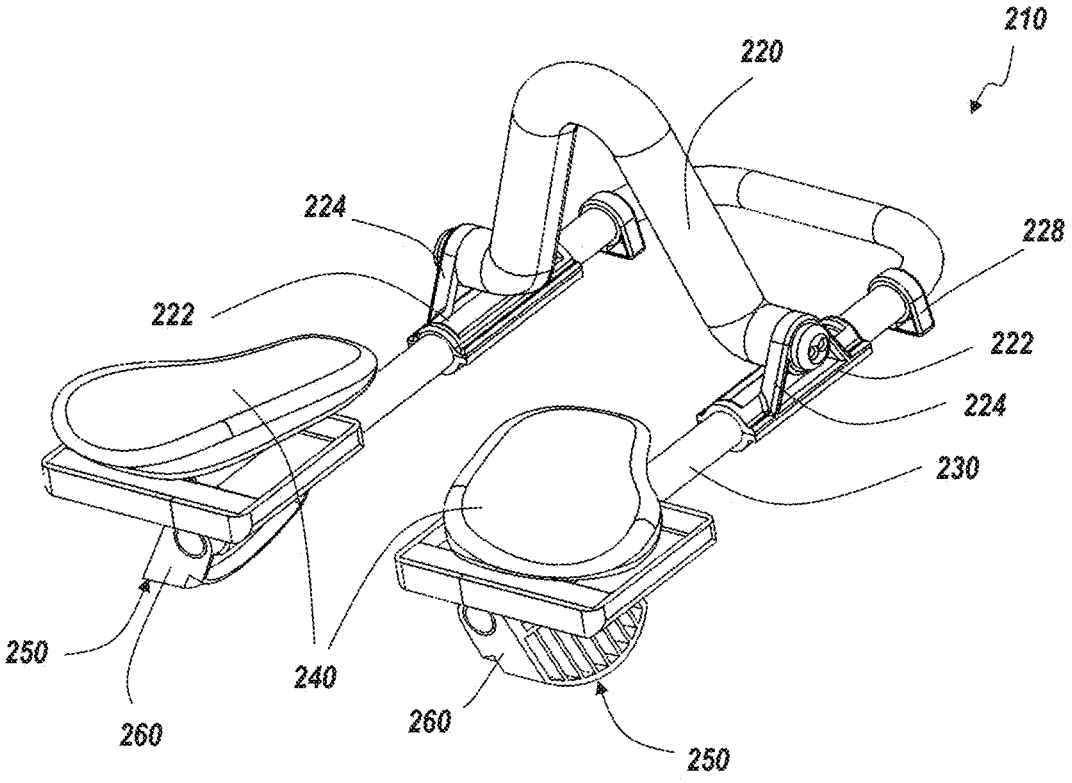
FIG. 14 is an isometric view illustration of the plank support exercise apparatus of FIG. 13, in accordance with the second exemplary embodiment of the present disclosure.

FIG. 14 is an isometric view illustration of the plank support exercise apparatus 210 of FIG. 13, in accordance with the second exemplary embodiment of the present disclosure. Relative to FIGS. 13-14, the apparatus 210 includes a destabilization device 260 which is positioned substantially underneath the arm support pad 240 (or each arm support pad present). The destabilization device 260 may function in the same manner as described in FIGS. 3-5, with the added function that the destabilization device 260 shown in FIGS. 13-14 may be movable between an extended position, shown in FIG. 14, where the ground-interface surface 250 positioned on the curved surface of the destabilization device 260 is contactable to a ground surface and a retracted position, shown in FIG. 13, where the ground-interface surface 250 positioned on the curved surface of the destabilization device 260 is removed from a contactable position with the ground surface. To achieve the movement between the extended and retracted positions, the destabilization device 260 may pivot about an axis, thereby allowing a specific surface or the destabilization device 260 to be oriented towards a ground surface. In FIG. 13, a flat edge of the destabilization device 260 may be oriented downwards (towards the ground surface) and in FIG. 14, the curved surface may be oriented downwards. When a user desires to use the apparatus 210 without destabilization, the user may select the configuration shown in FIG. 13. When the user desires an enhanced exercise by destabilizing the apparatus 210 with the curved surface of the destabilization device 260, the user would position the destabilization device 260 as shown in FIG. 14. It is noted that the foot pads 228 positioned along a front of the frame member 230 may act as ground-support devices at any point of use of the apparatus 210.

Relative to FIGS. 13-14 further, it is noted that the arm support pads 240 are also able to rotate, in the same manner as described relative to FIGS. 10-11, to provide arm trajectory user-adjustment of the apparatus 210 or to convert the apparatus 210 from a front plank orientation to a side plank orientation.

Relative to FIGS. 13-14, the apparatus 210 includes a hand grip 220 that is adjustable along the length of the frame member 230, whereby a distance between the hand grip 220 and the arm support pad 240 can be adjusted. The hand grip 220 may include a carriage 222 which is positioned about the frame member 230, or a portion thereof, and can be moved along the length of the frame member 230. The apparatus 210 may also include other devices for permitting movement of the hand grip 220 along the frame member 230. The carriage 222 may include a raised support 224 which receives an end of the hand grip 220 therein, such that the hand grip 220 can be rotated relative to the raised support 224. Accordingly, the hand grip 220 may be rotated between a lowered position, as shown in FIG. 13, and a raised position, as shown in FIG. 14. In the lowered position, the hand grip 220 may be stowed for convenient storage of the apparatus 210, whereas the raised position of the hand grip 220 may be a position where a user is actively using the apparatus 210. In some variations, rotating the hand grip 220 may provide benefits in the ergonomic use of the apparatus 210, not just to make the apparatus 210 more convenient for storage. For example, a user may rotate the hand grip 220 into a more comfortable angle.

It is also noted that the movable hand grip 220 may include two separate halves which operate independently of one another or which can be operated together. Other variations of moveable hand grips 220 may include hand grips 220 with male extenders that allow the hand grips 220 to connect or pop in to the frame member 230 along a length of the frame member 230, to allow adjustment of the positioning of the hand grips 220.

Figure 15:
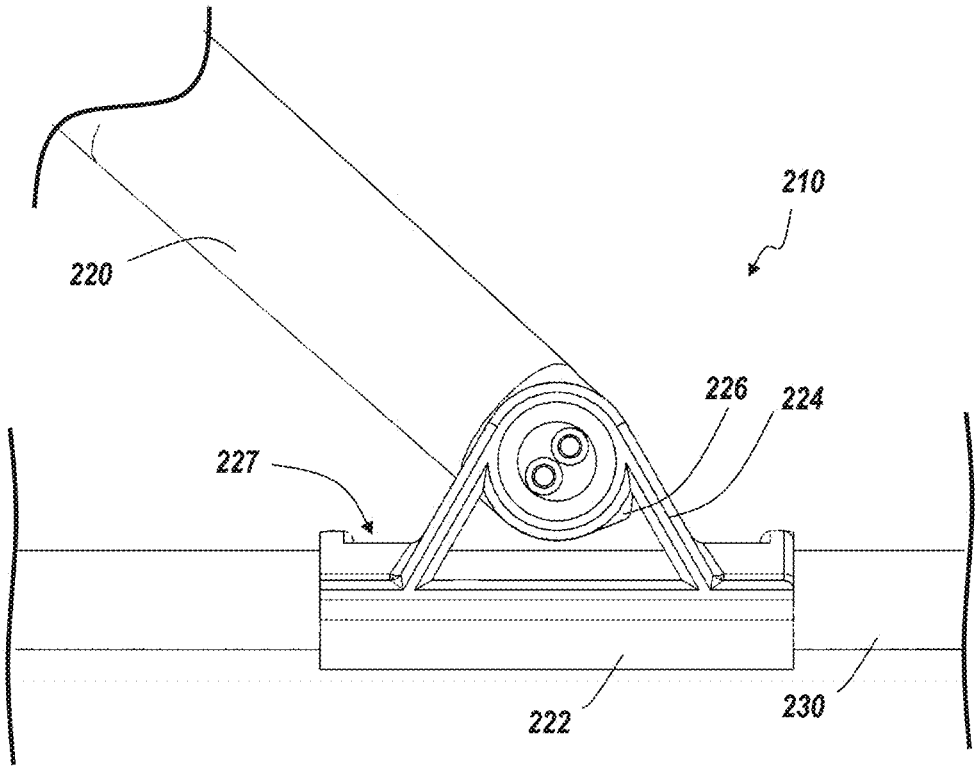
FIGS. 15-16 are side-view illustrations of the carriage and raised support of the plank support exercise apparatus of FIGS. 13-14, in accordance with the second exemplary embodiment of the present disclosure.
Figure 16:
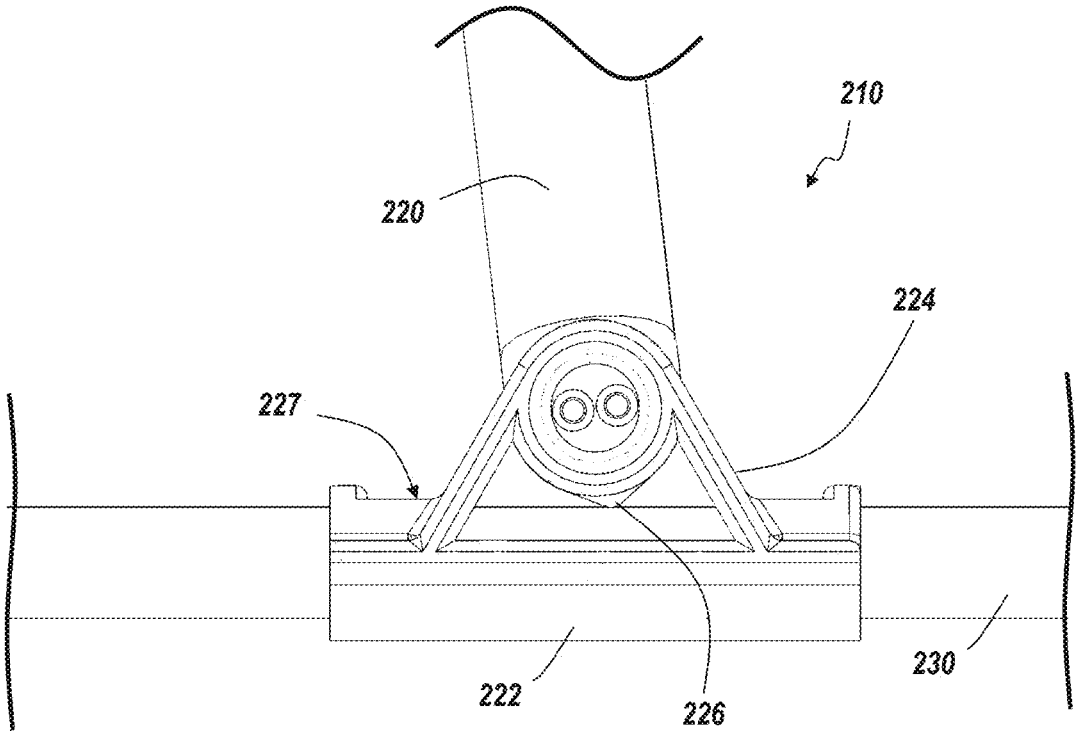

FIGS. 15-16 are side-view illustrations of the carriage 222 and raised support 224 of the plank support exercise apparatus 210 of FIGS. 13-14, in accordance with the second exemplary embodiment of the present disclosure. Relative to FIGS. 13-16, rotation of the hand grip 220 may be controlled, at least in part, with a frictional cam 226 which is connected to the hand grip 220 at a lower part thereof and is positioned to contact the frame member 230. The frictional cam 226 may include a rubberized structure which is rotatable opposite the hand grip 220. As is shown in FIGS. 15-16, the frictional cam 226 may be positioned proximate to the rotatable joint on which the hand grip 220 can rotate, such that when the hand grip 220 is in a fully or partially lowered position (FIGS. 13 and 15), the frictional cam 226 is free from contact. When the hand grip 220 is moved to the raised position (FIGS. 14 and 16), the frictional cam 226 may contact the frame member 230 through an aperture 227 within the carriage 222. The contact between the frictional cam 226 and the frame member 230 through the aperture 227 may be sufficient to retain the hand grip 220 in the raised position. Further, this contact may also be sufficient to limit the movement of the carriage 222 along the frame member 230.

Figure 17:
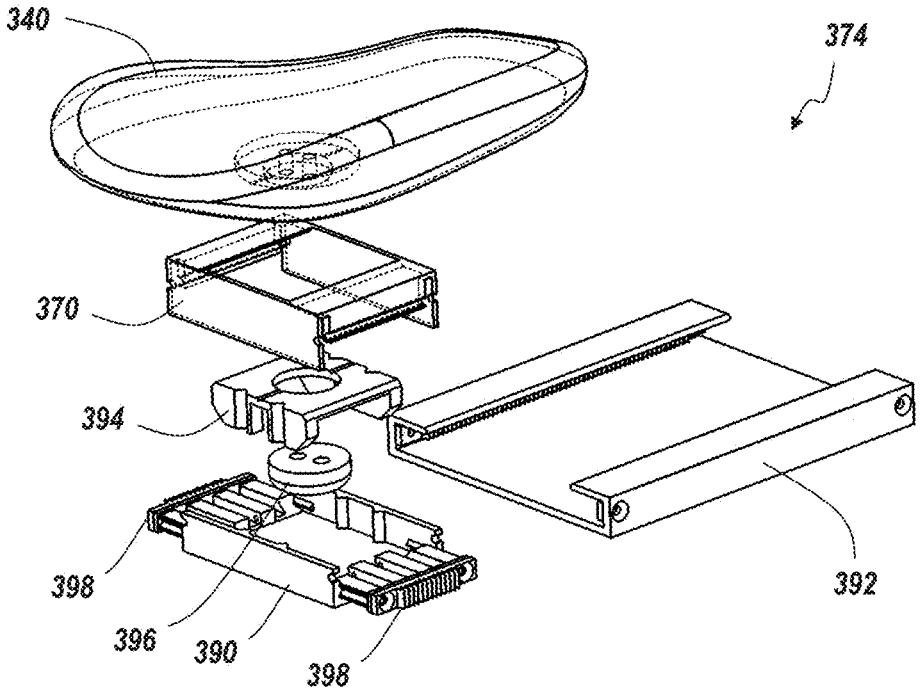
FIG. 17 is an exploded view illustration of a lateral movement device for use with a plank support exercise apparatus, in accordance with a third exemplary embodiment of the present disclosure.

FIG. 17 is an exploded view illustration of a lateral movement device 374 for use with a plank support exercise apparatus, in accordance with a third exemplary embodiment of the present disclosure. The lateral movement device 374 of the third exemplary embodiment may be used with the apparatus as described relative to any figure herein to achieve the same lateral movement as described relative to FIGS. 8-9. The lateral movement device 374 may facilitate lateral movement of the arm support pad 340 using a biasable track system which includes a biased engagement device 390 which is movable with a track 392. The track 392 may be mounted to a frame member or leg of the apparatus. When assembled, the arm support pad 340 may be affixed to hub 370 with biased engagement device 390 positioned in contact below it. A transfer housing 394 and stop 396 are positioned internal of engagement protrusions 398 of the biased engagement device 390. The stop 396 may connect to the underside of the arm support pad 340 with one or more fasteners and may facilitate rotation of the arm support pad 340 by acting as a rotatable interface, such as a Lazy Susan-type device, for the arm support pad 340. This rotation of the arm support pad 340 can be combined with the other mechanics of the lateral movement device 374.

In use, teeth on the engagement protrusions 398 may be engaged with teeth on the track 392 where there is weight applied to the arm support pad 340. When weight is removed from the arm support pad 340, the stop 396 may bias the transfer housing 394 upwards, thereby allowing the engaged protrusions 398 to retract a sufficient distance to disengage the teeth thereof from the teeth of the track 392. In this function, the user of a plank support exercise device may select the appropriate lateral position of the arm support pad 340 and then automatically lock the lateral position in place when he or she assumes a plank position on the apparatus.

Figure 18:
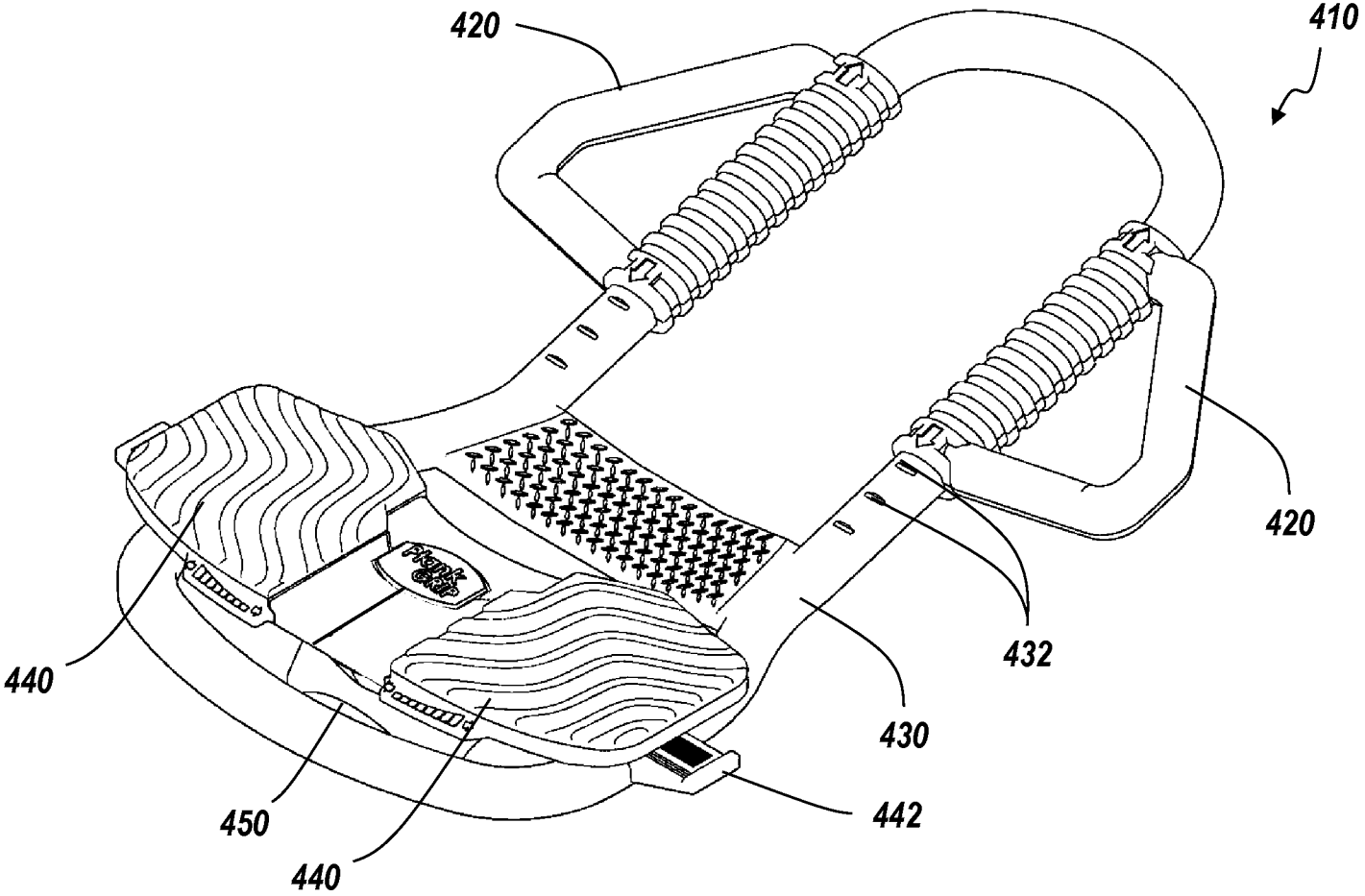
FIG. 18 is an isometric view illustration of a plank support exercise apparatus, in accordance with a fourth exemplary embodiment of the present disclosure.

FIG. 18 is an isometric view illustration of a plank support exercise apparatus 410, in accordance with a fourth exemplary embodiment of the present disclosure. The plank support exercise apparatus 410, which may be referred to herein as 'apparatus 410' may be substantially similar to the other apparatuses described within this disclosure and may include any of the features, components, or functions discussed relative to any other figure herein. The apparatus 410 of FIG. 18 includes a hand grip 420. A frame member 430 extends from the hand grip 420. At least one arm support pad 440 is connected to the frame member 430, wherein a distance between the hand grip 420 and the at least one arm support pad 440 is adjustable. A ground-interface surface 450 is positioned along at least a portion of the frame member 430.

The apparatus 410 of FIG. 18 includes a hand grip 420 formed from two distinct structures, each of which is carried on a portion of the frame member 430. The hand grips 420 are adjustable, such that the distance between the hand grips 420 and the at least one arm support pad 440 can be modified depending on a user's body size. The hand grip 420 may be movable by repositioning each of the hand grips 420 until they are locked within one of a plurality of preselected positions located at spaced intervals on the frame member 430. Specifically, as is shown in FIG. 18, the frame member 430 may include cavities 432 on a surface thereof which engage with a locking structure on the hand grip 420 to lock the hand grip 420 in place on the frame member 430. The locked nature of the hand grip 420 to the frame member 430 may be altered when a sufficient force is applied to the hand grip 420, such that the locking structure of the hand grip 420 is disengaged from the cavity on the frame member 430. In one of many possible variations, as previously noted, the moveable hand grips 420 may include male ridges or extenders that can be connected to or popped into the frame member 430 along the length of the frame member 430 to provide adjustment of the hand grips 420. When separate hand grips 420 are used, as is shown in FIG. 18, the hand grips 420 themselves may be able to be adjusted laterally on tracks or with holes, thereby allowing a distance between the hand grips 420 to be adjusted.

Figure 19:
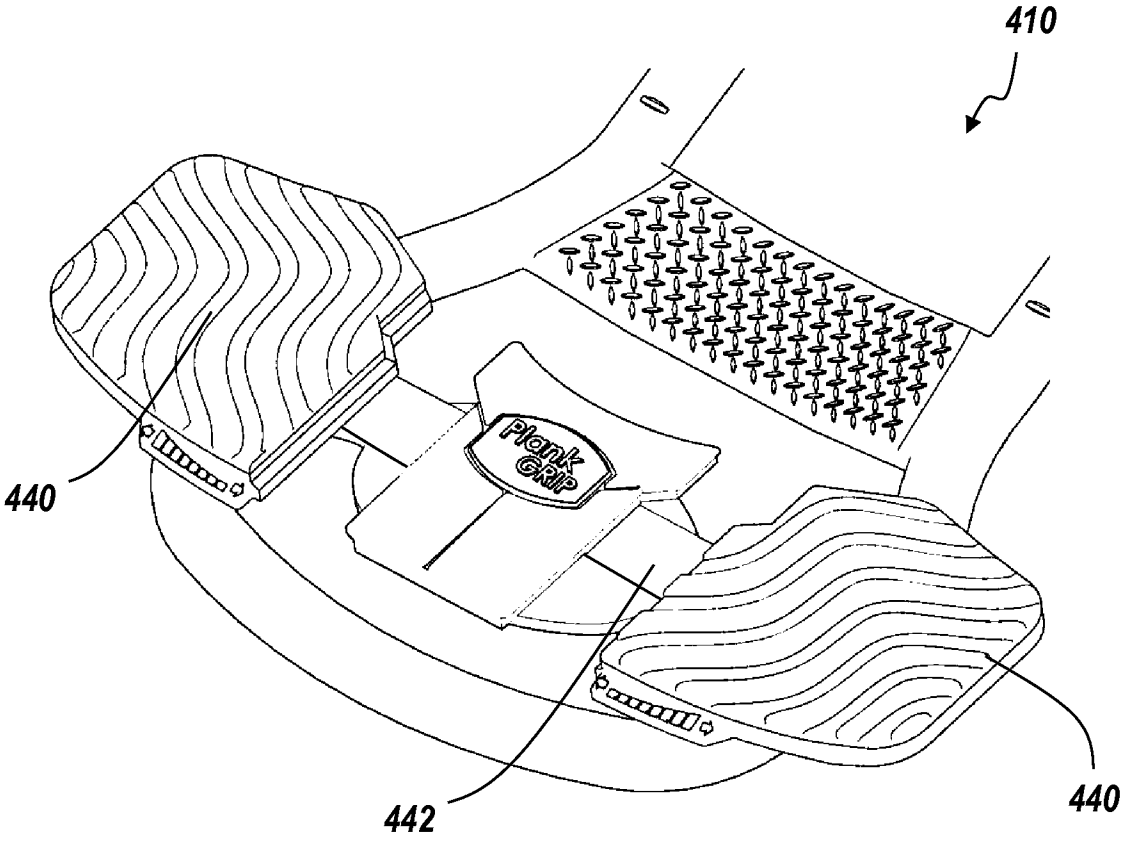
FIG. 19 is a detailed isometric view illustration of a plank support exercise apparatus of FIG. 18, in accordance with the fourth exemplary embodiment of the present disclosure.

FIG. 19 is a detailed isometric view illustration of a plank support exercise apparatus 410 of FIG. 18, in accordance with the fourth exemplary embodiment of the present disclosure. Relative to FIGS. 18-19, the apparatus 410 may have arm support pads 440 which are positioned on a unitary support bar 442. The unitary support bar 442 may be positioned in a lateral direction, relative to a general length of the apparatus 410, and allows the arm support pads 440 to be laterally adjusted, similar to as described relative to FIGS. 8-9. Accordingly, the arm support pads 440 may be positioned between an extended position on the unitary support bar 442, as is shown in FIG. 19, and a retracted position, as shown in FIG. 18.

Figure 20:
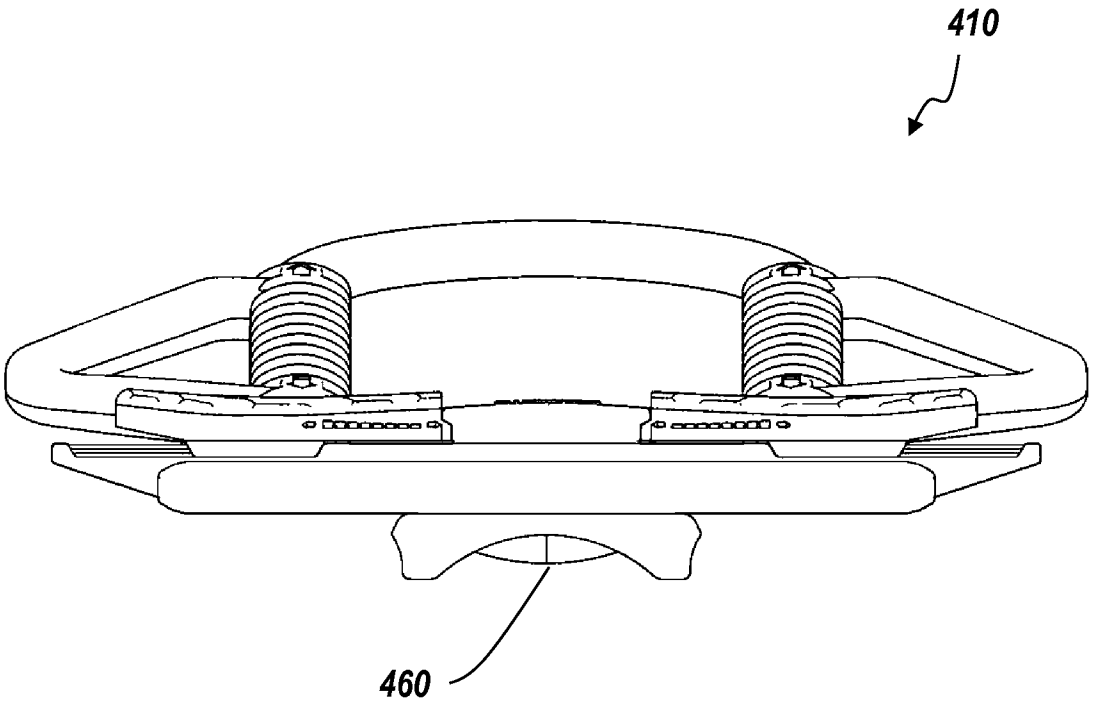
FIG. 20 is a front-view illustration of a plank support exercise apparatus of FIG. 18, in accordance with the fourth exemplary embodiment of the present disclosure.

FIG. 20 is a front-view illustration of a plank support exercise apparatus 410 of FIG. 18, in accordance with the fourth exemplary embodiment of the present disclosure. The apparatus 410 as shown in FIG. 20 illustrates a destabilization device 460 which is positioned under a substantially center point of the apparatus 410. The destabilization device 460 may include a semispherical structure which has a lowered edge that is positioned to contact a ground surface. In one example, the destabilization device 460 may include a semispherical structure formed from plastic, rubber, or similar material, which can support the weight of the apparatus 410 with a user on it. The destabilization device 460 may function as previously described, with the exception that it may allow movement of the apparatus 410 in more than one rotational degree of freedom. Using a semispherical surface as a destabilization device 460, as opposed to a curved surface along two dimensions, may allow three rotational degrees of freedom which provide enhanced destabilization movement.

Figure 21:
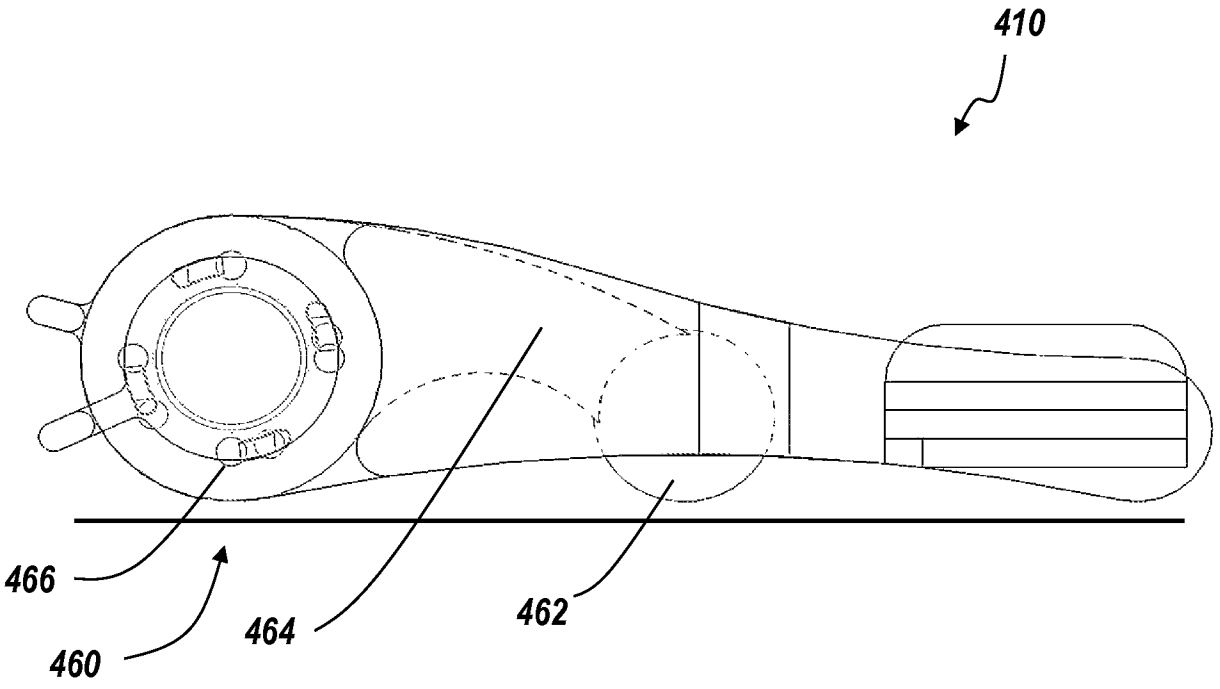
FIGS. 21-22 are side-view illustrations of a plank support exercise apparatus, in accordance with the fourth exemplary embodiment of the present disclosure.
Figure 22:
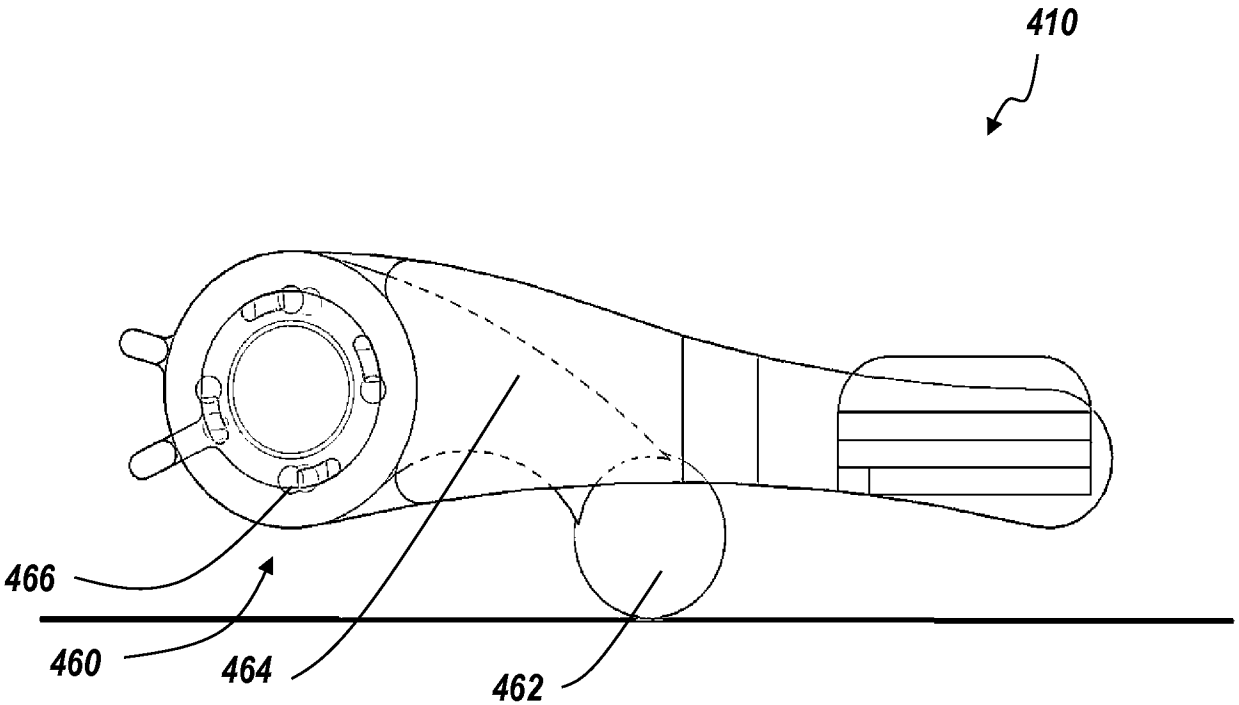

FIGS. 21-22 are side-view illustrations of a plank support exercise apparatus 410, in accordance with the fourth exemplary embodiment of the present disclosure. Similar to the destabilization device 460 of FIG. 20, FIGS. 21-22 illustrate a variation to a destabilization device 460 which can provide three rotational degrees of freedom. As is shown in FIGS. 21-22, the destabilization device 460 may include a semispherical structure 462 which is carried on an arm 464 that is movable between retracted and extended positions. A joint 466 may be used to move the arm 464, thereby moving the semispherical structure 462 between the retract position, shown in FIG. 21, to an extended position, shown in FIG. 22. The joint 466 may use levers to unlock a center section of the joint 466 to allow movement of the arm 464 or to lock the joint 466 to prevent arm 464 movement, such as by using a locking ball. In use, extending the arm 464 may increase the destabilization effect on the apparatus 410 whereas lowering or retracting the arm 464 may lessen the destabilization effect. Accordingly, a user can adjust the destabilization device 460 to achieve the desired destabilization effect.

Figure 23:
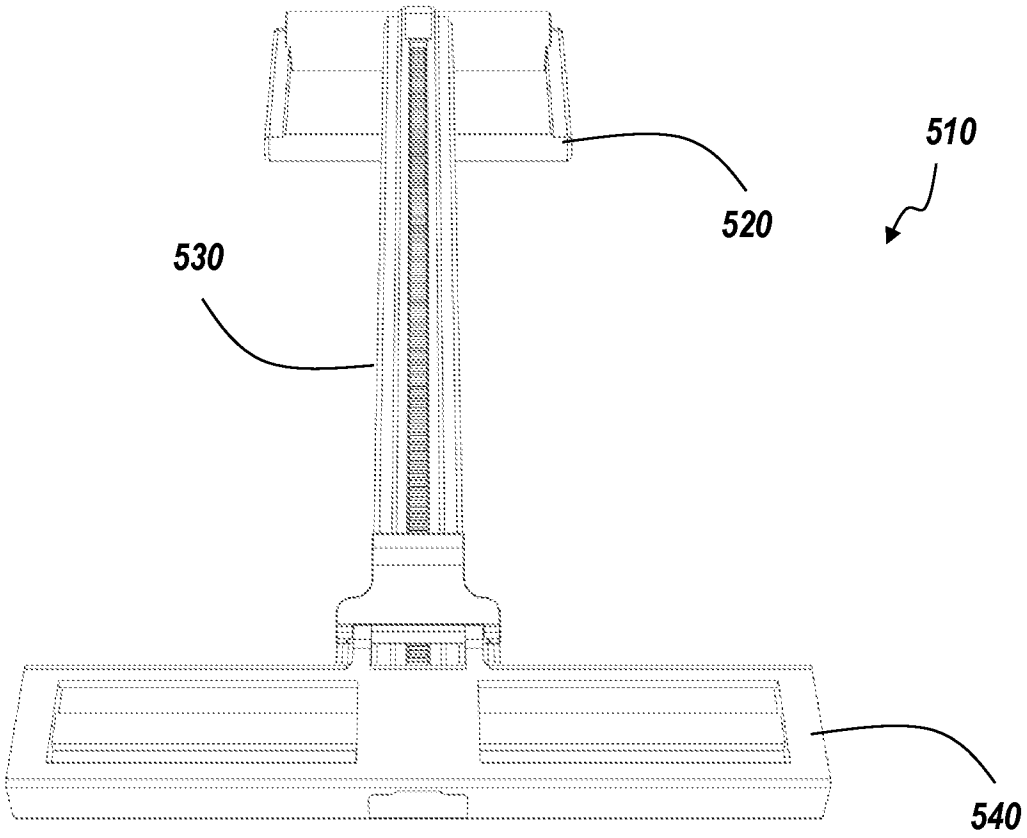
FIGS. 23-24 are isometric view illustrations of a plank support exercise apparatus, in accordance with the fourth exemplary embodiment of the present disclosure.
Figure 24:
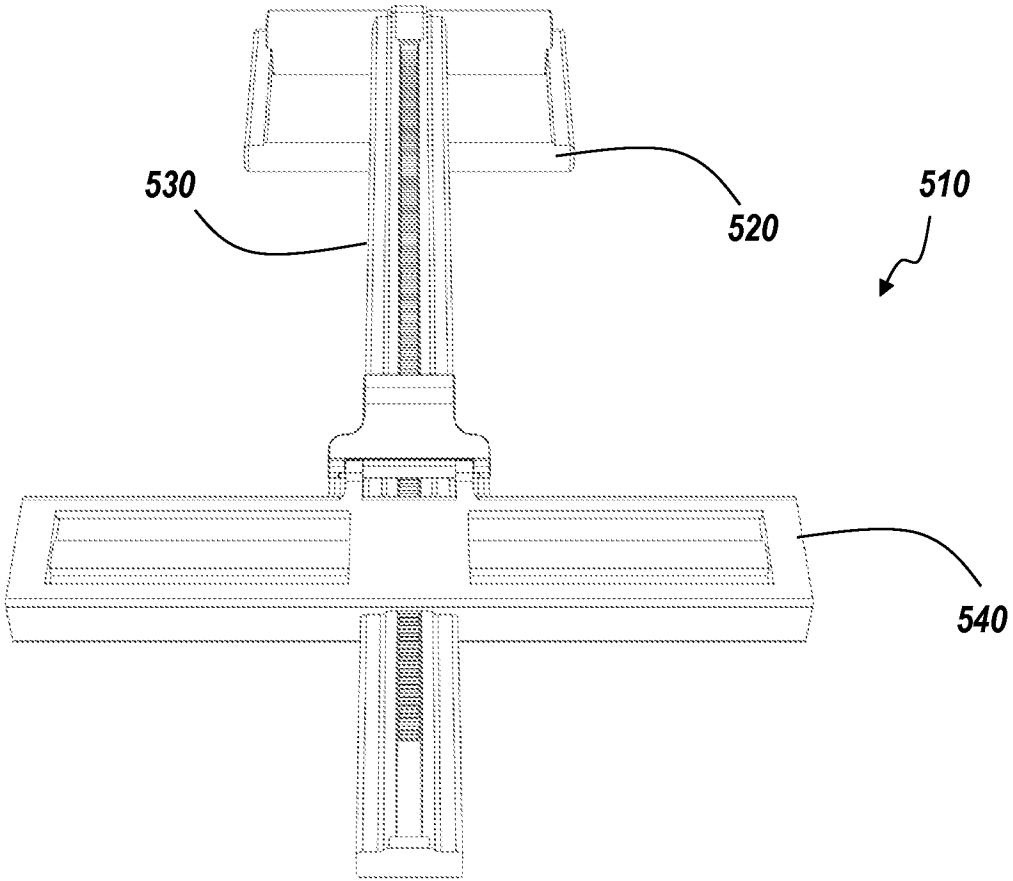

FIGS. 23-24 are isometric view illustrations of a plank support exercise apparatus 510, in accordance with a fifth exemplary embodiment of the present disclosure. The plank support exercise apparatus 510, which may be referred to herein as 'apparatus 510' may be substantially similar to the other apparatuses described within this disclosure and may include any of the features, components, or functions discussed relative to any other figure herein. As is shown in FIGS. 23-24, the apparatus 510 includes a central frame member 530 which is connected between a hand grip portion 520 and an arm support pad portion 540. It is noted that the actual hand grips and arm support pads that a user would touch are omitted from FIGS. 23-24. The central frame member 530 may permit adjustability of the arm support pad portion 540 along the length of the central frame member 530. The central frame member 530 may use, for example, a track system which allows the arm support pad portion 540 to be moved to selected locations along its length. FIG. 23 depicts the arm support pad portion 540 positioned at a distal end of the central frame member 530, whereas FIG. 24 depicts the arm support pad portion 540 positioned towards a middle section of the central frame member 530. The arm support pad portion 540 itself may also include a track to allow lateral movement of arm support pads, as previously described.

Figure 25:
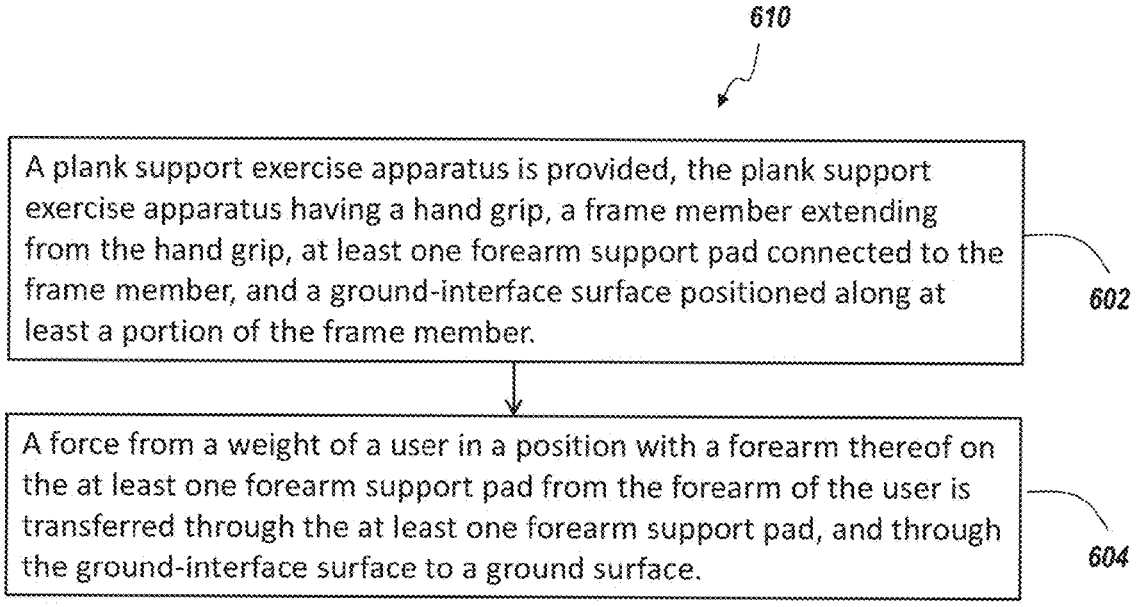
FIG. 25 is a flowchart illustrating a method of using a plank support exercise apparatus, in accordance with a fifth exemplary embodiment of the disclosure.

FIG. 25 is a flowchart 600 illustrating a method of using a plank support exercise apparatus, in accordance with a sixth exemplary embodiment of the disclosure. It should be noted that any process descriptions or blocks in flow charts should be understood as representing modules, segments, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 602, a plank support exercise apparatus is provided, the plank support exercise apparatus having a hand grip, a frame member extending from the hand grip, at least one forearm support pad connected to the frame member, and a ground-interface surface positioned along at least a portion of the frame member. A force from a weight of a user in a position with a forearm thereof on the at least one forearm support pad from the forearm of the user is transferred through the at least one forearm support pad, and through the ground-interface surface to a ground surface (block 604).

The method may include any additional number of steps, processes, and functions, including any disclosed within this disclosure. For example, when the plank support exercise apparatus is in use, an elbow of the user may be free from contact with the at least one forearm support pad. The method may include adjustment of the plank support exercise apparatus, such as moving the at least one forearm support pad along a length of the frame member, thereby adjusting a distance between the hand grip and the at least one forearm support pad, and/or moving the hand grip along a length of the frame member, thereby adjusting a distance between the hand grip and the at least one forearm support pad. The at least one forearm support pad may be moved in a lateral direction, wherein the lateral direction is substantially perpendicular to a length of the frame member and the at least one forearm support pad may be rotated about a substantially vertical axis thereof. Similarly, the hand grip may be rotated about a substantially horizontal axis thereof between a lowered position and a raised position. The method may further include destabilizing the plank support exercise apparatus with a destabilizing device, thereby facilitating a controlled, destabilizing movement of the plank support exercise apparatus. The controlled, destabilizing movement may further comprise translationally static movement and may further include movement in a single degree of rotational freedom.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A method of using a plank support exercise apparatus, the method comprising the steps of:

providing the plank support exercise apparatus having a frame member, two hand grip areas connected to the frame member, at least two forearm support pads connected to the frame member, and a ground-interface surface positioned along at least a portion of the frame member;

adjusting a first spacing distance of the two hand grip areas relative to the at least two forearm support pads;

adjusting a second spacing distance between the at least two forearm support pads without changing the first spacing distance between the two hand grip areas; and positioning a user on the plank support exercise apparatus, wherein a torso of the user is in a position substantially parallel to a ground surface with forearms thereof on the at least two forearm support pads and hands thereof on the hand grip.

2. The method of claim 1, further comprising moving the hand grip along a length of the frame member, thereby adjusting a distance between the hand grip and the at least at least two forearm support pads.

3. The method of claim 1, further comprising destabilizing the plank support exercise apparatus with a destabilizing device, thereby facilitating a destabilizing movement of the plank support exercise apparatus.

4. The method of claim 1, further comprising adjusting the first spacing distance while the torso of the user is in the position substantially parallel to the ground surface with forearms thereof on the at least two forearm support pads and hands thereof on the two hand grip areas.

5. The method of claim 4, wherein the destabilizing movement further comprises a single degree of rotational movement.

6. The method of claim 1, further comprising adjusting the second spacing distance between the at least two forearm support pads without removing the at least two forearm support pads from a common plane.

7. The method of claim 1, wherein adjusting the second spacing distance between the at least two forearm support pads without changing the first spacing distance between the two hand grip areas further comprises moving the at least at least two forearm support pads in a lateral direction relative to one another.

* * * * *